US008234828B2

(12) United States Patent
MacDonald

(10) Patent No.: US 8,234,828 B2
(45) Date of Patent: Aug. 7, 2012

(54) VENEERS FOR WALLS, RETAINING WALLS, RETAINING WALL BLOCKS, AND THE LIKE

(75) Inventor: Robert A. MacDonald, Plymouth, MN (US)

(73) Assignee: Keystone Retaining Wall Systems LLC, West Chester, OH (US)

( * ) Notice: Subject to any disclaimer, the term of this patent is extended or adjusted under 35 U.S.C. 154(b) by 687 days.

(21) Appl. No.: 12/144,228

(22) Filed: Jun. 23, 2008

(65) Prior Publication Data

US 2008/0313988 A1 Dec. 25, 2008

Related U.S. Application Data

(60) Provisional application No. 60/945,457, filed on Jun. 21, 2007.

(51) Int. Cl.
*E04F 13/08* (2006.01)

(52) U.S. Cl. ..... 52/391; 52/386; 52/476; 52/477; 52/511

(58) Field of Classification Search ..... 52/391, 52/386, 476, 477, 511, 489.1, 489.2, 311.1
See application file for complete search history.

(56) References Cited

U.S. PATENT DOCUMENTS

| | | | | |
|---|---|---|---|---|
| 1,593,297 | A * | 7/1926 | Gilmer | 52/386 |
| 2,121,037 | A | 6/1938 | Kotrbaty | |
| 2,130,531 | A * | 9/1938 | Arand | 52/506.09 |
| 2,918,814 | A | 12/1959 | Farina | |
| 3,555,757 | A | 1/1971 | Volent | |
| 3,660,954 | A | 5/1972 | Logan | |
| 3,686,873 | A | 8/1972 | Vidal | |
| 3,701,228 | A * | 10/1972 | Taylor | 52/309.8 |
| 3,895,469 | A | 7/1975 | Kapitan | |
| 3,950,908 | A | 4/1976 | Van Eyk | |
| 4,229,920 | A | 10/1980 | Lount | |
| 4,238,105 | A | 12/1980 | West | |
| 4,449,857 | A | 5/1984 | Davis | |
| 4,454,699 | A | 6/1984 | Strobl | |
| 4,470,728 | A | 9/1984 | Broadbent | |
| 4,545,703 | A | 10/1985 | Boynton | |
| 4,564,316 | A | 1/1986 | Hunziker | |
| 4,593,513 | A | 6/1986 | Stratton | |

(Continued)

FOREIGN PATENT DOCUMENTS

CA 2 526 876 A1 2/2006

(Continued)

OTHER PUBLICATIONS

U.S. Appl. No. 12/124,311, filed May 21, 2008, entitled Wall Block and Wall Block System for Constructing Walls (26 pages).

(Continued)

*Primary Examiner* — Brian Glessner
*Assistant Examiner* — Adam Barlow
(74) *Attorney, Agent, or Firm* — Popovich, Wiles & O'Connell, P.A.

(57) ABSTRACT

Veneers for walls, retaining walls, retaining wall blocks, gabions, wire faces, and other structures are provided. Various methods of attaching the veneers are also described. A combination of a wall block and a veneer is provided. The wall block has a front face with a block connection space, and the veneer has a front face with a veneer connection portion. The veneer is attached to the front face of the wall block by the veneer connection portion, which is disposed in the block connection space.

35 Claims, 32 Drawing Sheets

U.S. PATENT DOCUMENTS 4,661,023 A 4/1987 Hilfiker
4,684,287 A 8/1987 Wojciechowski
4,706,429 A 11/1987 Young
4,884,382 A 12/1989 Horobin
4,884,921 A 12/1989 Smith
4,885,888 A 12/1989 Young
4,887,691 A 12/1989 Rotondo
4,894,969 A 1/1990 Horobin
4,913,594 A 4/1990 Sigourney
4,967,532 A 11/1990 Castle et al.
4,993,879 A 2/1991 Hilfiker
5,428,933 A 7/1995 Philippe
5,524,405 A 6/1996 Byrd
5,538,363 A 7/1996 Eastwood
5,551,810 A 9/1996 Franceski et al.
5,567,089 A 10/1996 Akamine
5,588,786 A 12/1996 House et al.
5,623,797 A 4/1997 Gravier et al.
5,688,078 A * 11/1997 Hammer ..... 405/286
5,735,643 A 4/1998 Castonguay et al.
5,788,423 A 8/1998 Perkins
5,823,717 A 10/1998 Bastick et al.
D404,146 S * 1/1999 Perkins ..... D25/113
5,878,545 A 3/1999 Gebhart
5,930,964 A 8/1999 Boehning
5,934,035 A 8/1999 Rasmussen et al.
6,024,516 A 2/2000 Taylor et al.
6,062,772 A 5/2000 Perkins
6,070,380 A 6/2000 Meilleur
6,176,049 B1 1/2001 Crant et al.
6,230,462 B1 5/2001 Beliveau
6,314,697 B1 11/2001 Moore, Jr.
6,318,040 B1 11/2001 Moore, Jr.
6,363,683 B1 4/2002 Moore, Jr.
6,374,556 B2 4/2002 Crant et al.
6,401,419 B1 6/2002 Beliveau
6,443,666 B1 9/2002 Smith
6,523,312 B2 2/2003 Budge
6,526,713 B2 3/2003 Moore, Jr.
6,536,172 B1 3/2003 Amend
6,578,338 B1 6/2003 Nanayakkara
6,607,683 B1 8/2003 Harrington
6,668,502 B2 12/2003 Beliveau
6,668,503 B2 12/2003 Beliveau
6,708,459 B2 3/2004 Bodnar
6,758,636 B2 7/2004 Rainey et al.
6,792,729 B2 9/2004 Beliveau
6,820,384 B1 11/2004 Pfeiffer
6,827,527 B2 12/2004 Conkel et al.
6,848,228 B1 2/2005 Williams
6,964,137 B2 * 11/2005 Frascari ..... 52/235
6,978,581 B1 12/2005 Spakousky
6,990,774 B2 1/2006 Clapp
7,032,357 B2 4/2006 Cooper et al.
7,082,731 B2 8/2006 Patz et al.
7,082,732 B2 8/2006 Titishov
7,121,051 B2 10/2006 Hunsaker
7,165,374 B2 1/2007 Ohanesian
7,165,916 B2 1/2007 Nanayakkara
7,235,204 B2 6/2007 Harrington
7,410,328 B2 * 8/2008 Hamel ..... 405/286
2001/0027630 A1 10/2001 Moore, Jr. et al.
2002/0078649 A1 6/2002 Clapp
2005/0204679 A1 9/2005 Pfeiffer
2005/0204699 A1 9/2005 Rue
2005/0242468 A1 11/2005 MacDonald et al.
2005/0252144 A1 11/2005 MacDonald et al.
2005/0252145 A1 11/2005 MacDonald et al.
2005/0252146 A1 11/2005 MacDonald et al.
2005/0252147 A1 11/2005 MacDonald et al.
2006/0197257 A1 9/2006 Burt et al.
2006/0260240 A1 11/2006 Patz et al.
2006/0263575 A1 11/2006 Ritchie
2007/0044426 A1 3/2007 Deans
2007/0151190 A1 * 7/2007 Huff et al. ..... 52/592.5
2009/0013638 A1 1/2009 Clarno

FOREIGN PATENT DOCUMENTS

EP 174882 A1 * 3/1986
WO WO 2005/108683 A1 11/2005
WO WO 2007/069027 A2 6/2007
WO WO 2008/092237 A1 8/2008

OTHER PUBLICATIONS

Oct. 5, 2005 Notification of Transmittal of the International Search Report and the Written Opinion of the International Searching Authority, or the Declaration in PCT/US2005/014769 (12 pages).

* cited by examiner

Fig. 3
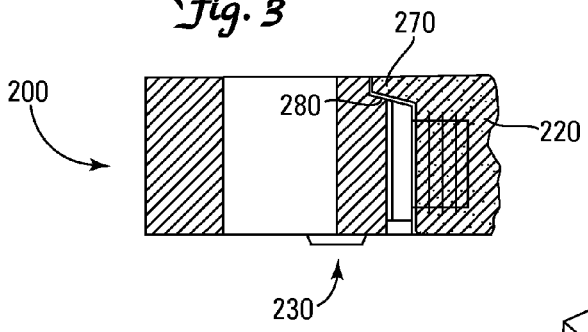
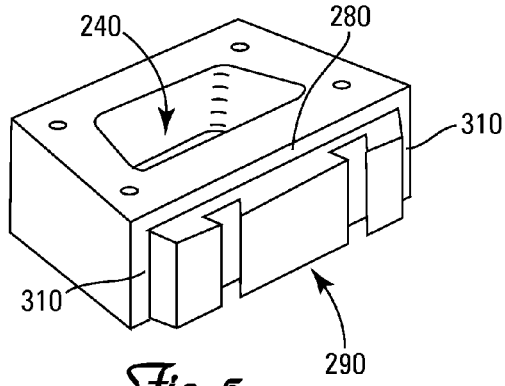
Fig. 5
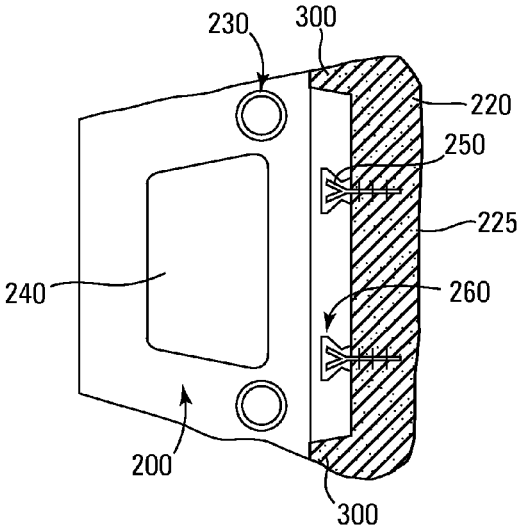
Fig. 4
Fig. 6
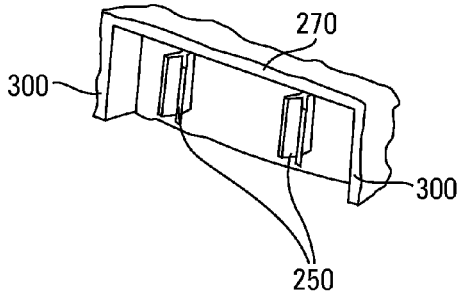

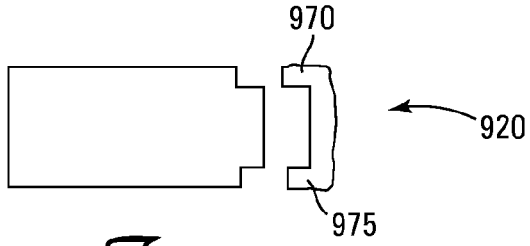
Fig. 12
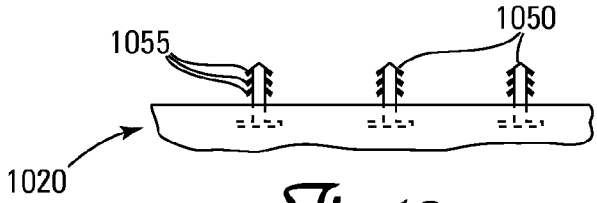
Fig. 13
Fig. 14
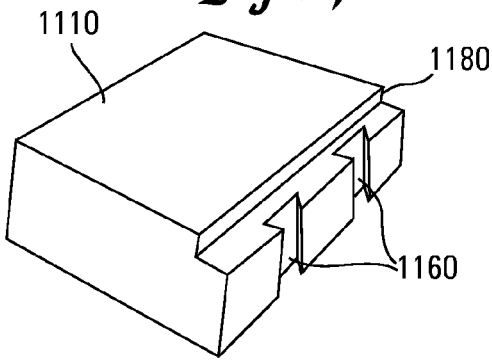
Fig. 15
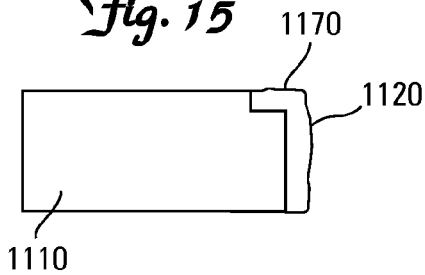

Fig. 16A
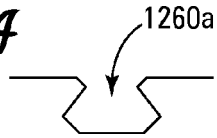
Fig. 16B
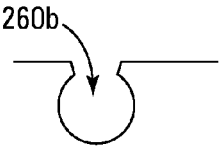
Fig. 16C
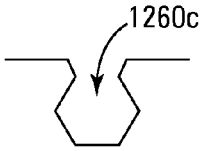
Fig. 16D
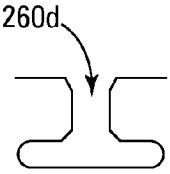
Fig. 17
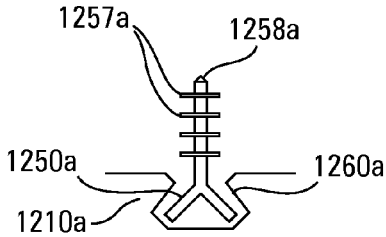
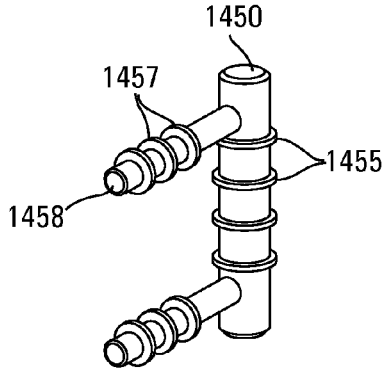
Fig. 19
Fig. 18
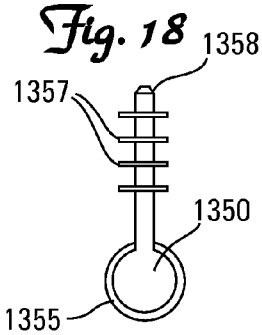
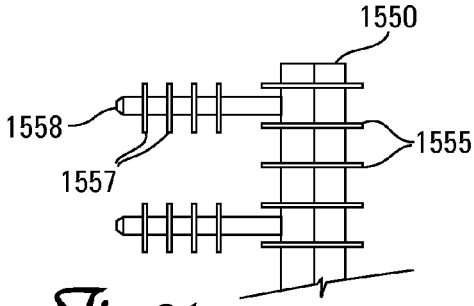
Fig. 21
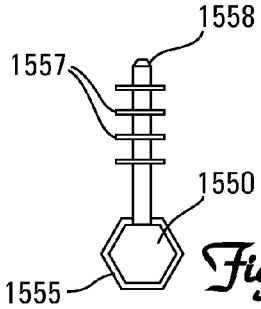
Fig. 20
Fig. 22
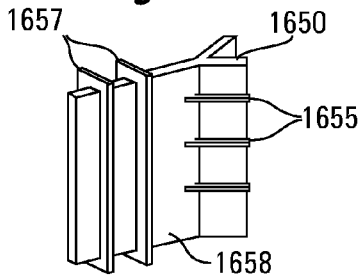

Fig. 23A
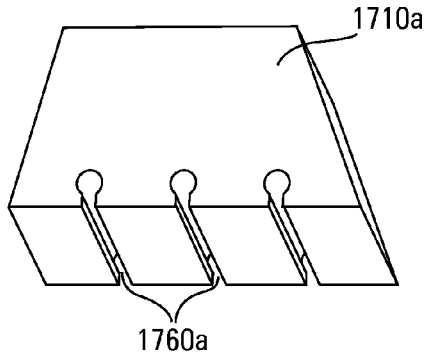
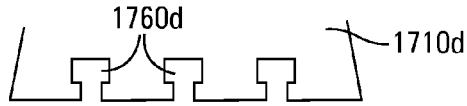
Fig. 23D
Fig. 24A
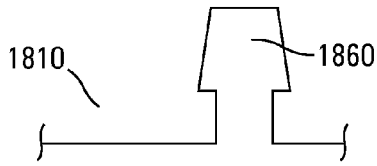
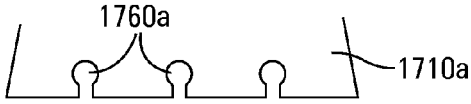
Fig. 23B
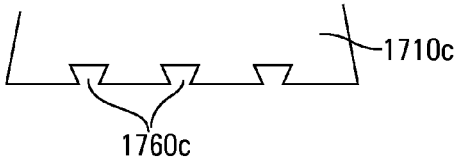
Fig. 23C
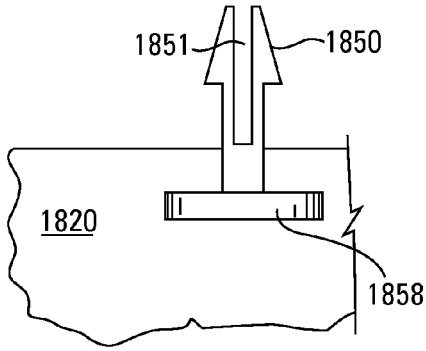
Fig. 24B
Fig. 25
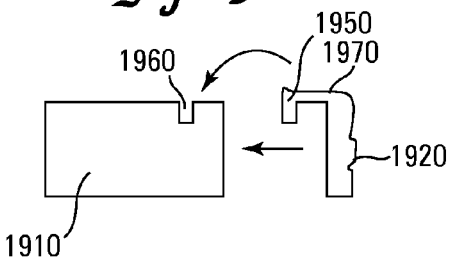
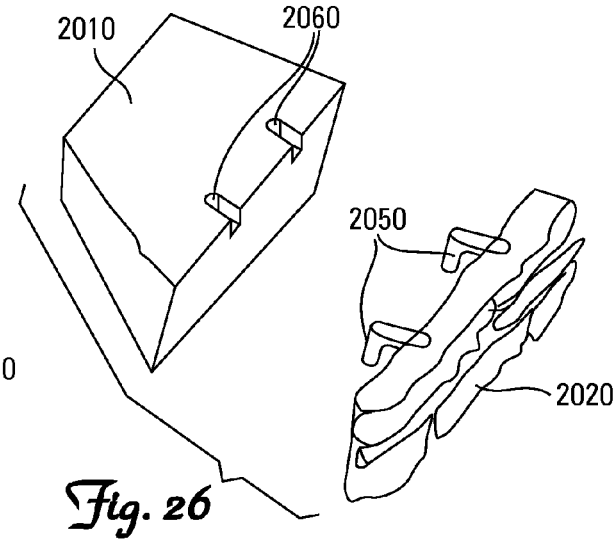
Fig. 26

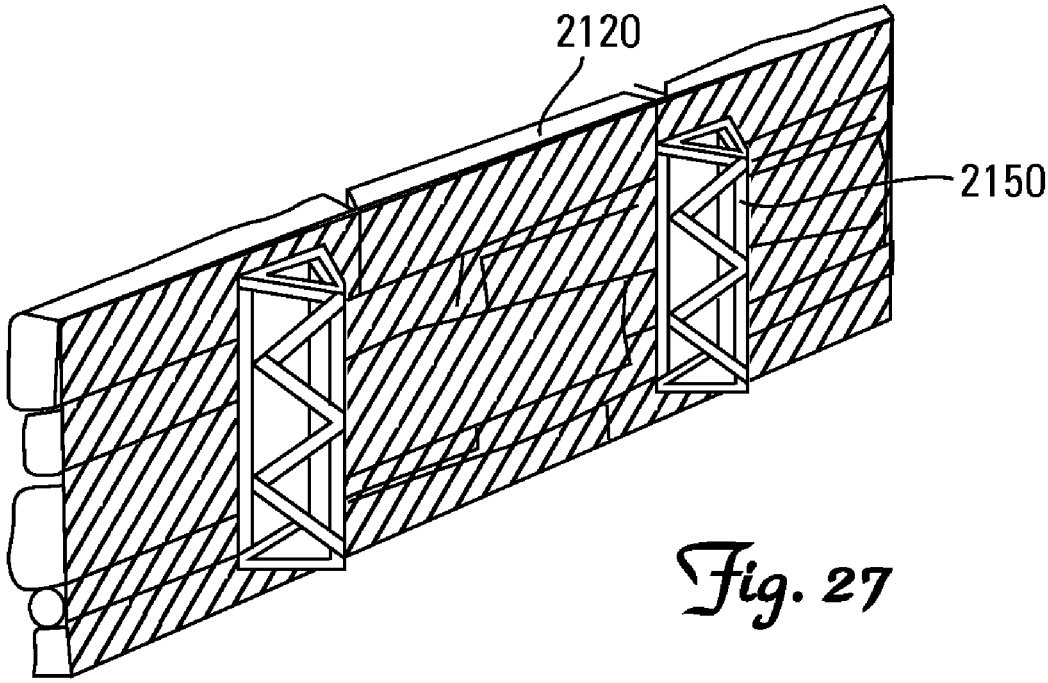
Fig. 27
Fig. 28
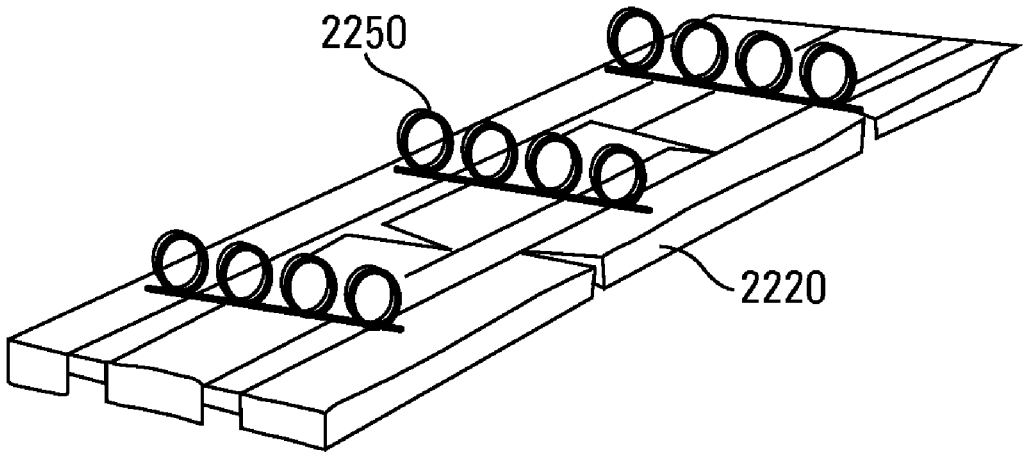

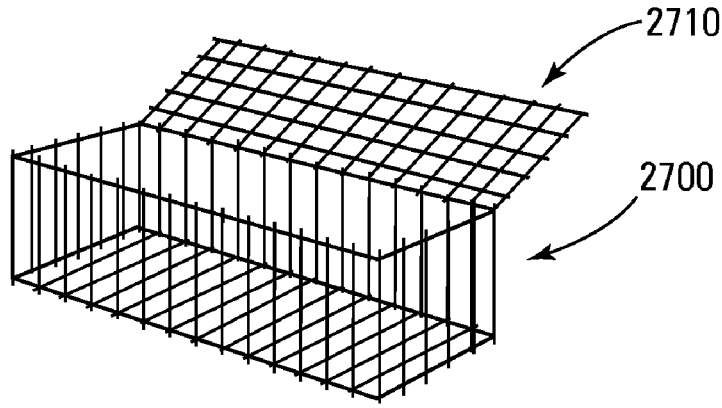
Fig. 37A
Fig. 37B
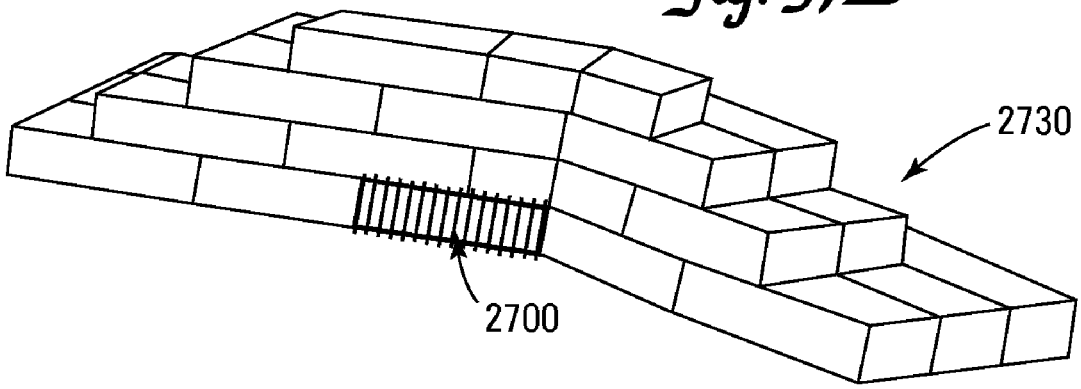

VENEERS FOR WALLS, RETAINING WALLS, RETAINING WALL BLOCKS, AND THE LIKE

This application claims the benefit of U.S. Provisional Application No. 60/945,457, filed Jun. 21, 2007, entitled "Veneers for Walls, Retaining Walls, Retaining Wall Blocks, and the Like", the contents of which are hereby incorporated by reference herein.

FIELD OF THE INVENTION

This invention relates to veneers. In particular, the invention relates to veneers for walls, retaining walls, retaining wall blocks, and the like.

BACKGROUND OF THE INVENTION

Retaining walls are used in various landscaping projects and are available in a wide variety of styles. Numerous methods and materials exist for the construction of retaining walls. Such methods include the use of natural stone, poured concrete, precast panels, masonry, and landscape timbers or railroad ties.

A widely accepted method of construction of such walls is to dry stack concrete wall units, or blocks. These blocks are popular because they are mass produced and, consequently, relatively inexpensive. They are structurally sound, easy and relatively inexpensive to install. Because they comprise concrete, they are durable. They can be given a desired appearance, such as, for example, natural stone. Many block systems also use pins that are adapted to fit in corresponding pin holes in adjacent blocks or may use other mechanical means to contribute to the stability of a wall.

Typically, retaining wall blocks are manufactured to have the desired appearance on the front face (i.e., the outer face of a wall) because only the front is visible after the wall is constructed. It is highly desirable to have the front face of the wall system have a natural stone appearance, and many approaches are used in the art to treat or process concrete to evoke the appearance of natural stone, including splitting the block, tumbling the block to weather the face and edges of the face, and using processing or texturing equipment to impart a weathered look to the concrete.

Depending upon their location, the soil type, the amount of water that can flow through the wall, and the mineral content of the water, an undesirable appearance can develop on the surface of a retaining wall. In addition, due to exposure to the elements and freeze/thaw cycles, concrete retaining walls may exhibit spalling, that is, chipping and cracking of concrete, which affects their appearance and can ultimately affect their utility. Freeze-thaw effects are worsened when the wall face is exposed to salt spray, which commonly occurs on roadways where de-icing salts are used to clear the road of ice and snow. Efflorescence refers to the leaching of mineral salts from water and this often occurs on walls in contact with water. The resultant deposit on a surface creates an unattractive white stained appearance on a wall.

There have been prior efforts to add a veneer to regular and segmental retaining walls with natural stone or concrete that is pre-cast molded to closely resemble natural stone. While such veneering produces aesthetically pleasing walls, it is a laborious and highly expensive process, as it requires skilled masonry work to tie in the stone or concrete veneer to the wall using traditional mortared masonry construction methods. Such veneering can double the cost of the finished wall. In addition, segmental retaining walls are not rigid structures and applying a rigid mortared veneer may cause cracking unless appropriate steps are taken to provide slip joints that allow for such movement. Veneers for retaining walls are described in US 2005/0252144 A1, the contents of which are incorporated by reference herein.

SUMMARY OF THE INVENTION

The invention provides veneers for walls, retaining walls, retaining wall blocks, gabions (basket structures), wire faces, and other structures. Various methods of attaching the veneers are also described.

The invention provides a combination comprising a wall block and a veneer. The wall block has a front face, the front face has a block connection space, the veneer has a front face, and the veneer has a veneer connection portion. The veneer is attached to the front face of the wall block by the veneer connection portion, which is disposed in the block connection space.

The invention provides a combination comprising a wall block, a veneer, and a connector. The wall block has a front face, the front face has a block connection space, the veneer has a front face, and the veneer has a veneer connection space. The veneer is attached to the front face of the wall block by the connector, which is disposed in the block connection space and in the veneer connection space.

The invention provides a combination comprising a wall block and a veneer. The wall block has a front face and a top face, the top face has a block connection space, the veneer has a front face, and the veneer has a veneer connection portion. The veneer is disposed adjacent the front face of the wall block and the veneer is attached to the top face of the wall block by the veneer connection portion, which is disposed in the block connection space.

The invention provides a real stone veneer comprising a tray having veneer connection portions. The real stone is attached to the tray with an adhesive, and the tray comprises holes that contain adhesive.

The invention provides a real stone veneer comprising a tray having veneer connection portions. The real stone is attached to the tray with an adhesive, and the tray comprises wells that contain adhesive.

The invention provides a real stone veneer comprising a tray having veneer connection portions. The real stone is attached to the tray with an adhesive, and the tray comprises a honeycomb structure that contains adhesive.

The invention provides walls comprising any of the combinations comprising a wall block and a veneer that are described herein.

The invention provides a wall comprising two or more wall blocks and two or more veneers. The wall blocks have front faces, the front faces have block connection spaces, the veneers have front faces, and the veneers have veneer connection portions. The veneers are attached to the front faces of the wall blocks by the veneer connection portions which are disposed in the block connection spaces. The veneers have front faces of at least two different sizes.

The invention provides a wall comprising two or more wall blocks and two or more veneers. The wall blocks have front faces, the front faces have block connection spaces, the veneers have front faces, and the veneers have veneer connection portions. The veneers are attached to the front faces of the wall blocks by the veneer connection portions which are disposed in the block connection spaces. The veneers have front faces of at least two different colors.

The invention provides a wall comprising two or more wall blocks, two or more veneers, and two or more connectors. The wall blocks have front faces, the front faces have block connection spaces, the veneers have front faces, and the veneers have veneer connection spaces. The veneers are attached to the front faces of the wall blocks by the connectors which are disposed in the block connection spaces and the veneer connection spaces. The veneers have front faces of at least two different sizes.

The invention provides a wall comprising two or more wall blocks, two or more veneers, and two or more connectors. The wall blocks have front faces, the front faces have block connection spaces, the veneers have front faces, and the veneers have veneer connection spaces. The veneers are attached to the front faces of the wall blocks by the connectors which are disposed in the block connection spaces and the veneer connection spaces. The veneers have front faces of at least two different colors.

The invention provides a wall comprising two wall blocks and a veneer, the wall blocks having front faces, the front faces having block connection spaces, the veneer having a front face, the veneer having a veneer connection portion, the veneer being attached to the front faces of the wall blocks by the veneer connection portion, and the front face of the veneer having a larger area than the combined area of the front faces of the two wall blocks.

The invention provides a combination comprising a first wall block, a second wall block, and a tensile connector. Each wall block has a front face and a rear face, and the front face and the rear face each having a block connection space. The first wall block being connected to the second wall block by a tensile connector, which is disposed in the block connection spaces in the rear faces of the first and second blocks. The invention provides a wall comprising this combination.

The invention provides a combination comprising a wall and two or more cast polymer veneers attached to the wall.

The invention provides a wall comprising wire face elements and veneers attached to the wire face elements.

The invention provides a wall comprising wire baskets and veneers attached to front faces of the wire baskets.

The invention provides a wall block having a front face, the front face comprising two or more wall block connection spaces.

It is to be understood that both the foregoing general description and the following detailed description are exemplary and explanatory and are intended to provide further explanation of the invention as claimed.

BRIEF DESCRIPTION OF THE SEVERAL VIEWS OF THE DRAWING

FIG. 3 is a cross-sectional view of a retaining wall block with a veneer.

FIG. 4 is a bottom view of a retaining wall block with a veneer.

FIG. 5 is a perspective view of a retaining wall block.

FIG. 6 is a perspective view of a veneer.

FIG. 12 is a side view of a veneer and a retaining wall block.

FIG. 13 is a top view of a veneer.

FIG. 14 is a perspective view of a retaining wall block.

FIG. 15 is a side view of a veneer and a retaining wall block.

FIGS. 16A to 16D are top views of different wall block connection spaces.

FIG. 17 is a top view of a dovetail wall connection space and dovetail veneer connection portion.

FIG. 18 is a top view of a veneer connection portion and an anchoring portion.

FIG. 19 is a perspective view of a veneer connection portion and anchoring portions.

FIG. 20 is a top view of a veneer connection portion and anchoring portions.

FIG. 21 is a side view of a veneer connection portion and anchoring portions.

FIG. 22 is a perspective view of a veneer connection portion and an anchoring portion.

FIGS. 23A is a perspective view of a retaining wall block.

FIGS. 23B to 23D are top views of portions of a retaining wall block.

FIGS. 24A and 24B are side views of a portion of a retaining wall block and a veneer.

FIG. 25 is a side view of a retaining wall block and a veneer.

FIG. 26 is a perspective view of a retaining wall block and a veneer.

FIG. 27 is a perspective view of a real stone veneer.

FIG. 28 is a perspective view of a real stone veneer.

FIG. 37A is a perspective view of a gabion.

FIG. 37B is a perspective view of a wall made of gabions.

DETAILED DESCRIPTION OF THE PREFERRED EMBODIMENTS

Figure 1:
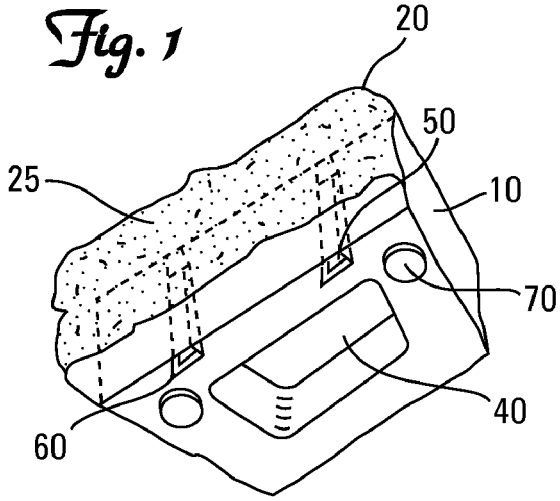
FIG. 1 is a perspective view of a retaining wall block with a veneer.

In this application, "wall" can refer to structures comprising natural stone, poured concrete, precast panels, masonry, landscape timbers or railroad ties, retaining wall blocks, and exterior and interior walls of buildings. Veneers are attached to the exposed surfaces of a wall.

In one embodiment of the invention, the veneers are used with retaining walls, and in a preferred embodiment, the retaining walls comprise blocks. The retaining wall blocks can be made of a rugged, weather resistant material, preferably (and typically) zero-slump molded concrete. Other suitable materials include polymers, composite materials with reinforced fibers, wood, metal, stone, etc. The blocks may have various shapes and characteristics, as known in the art, and may be stacked one upon the other to provide a vertically straight wall, and also may be stacked so that they are angled or set back from vertical. As known in the art, the blocks may be connected to each other by a pin attachment system, or the blocks may be provided with one or more protruding elements that interlock with one or more corresponding recesses in an adjacent block. Blocks that can be used with the veneers of the invention are described in U.S. patent application Ser. No. 12/124,311, filed May 21, 2008, entitled "Wall Block and Wall Block System for Constructing Walls", the contents of which are hereby incorporated by reference herein.

"Upper" and "lower" refer to the placement of the block in a retaining wall. The lower, or bottom, surface is placed such that it faces the ground. In a retaining wall, one row of blocks is laid down, forming a course. An upper course is formed on top of this lower course by positioning the lower surface of one block on the upper surface of another block.

Retaining walls may be straight (i.e., substantially linear, as well as vertically straight), curved (concave, convex, or serpentine) or may have sharp corners (i.e., 90 degree angles). Such walls can be angled from vertical. Reinforcing geogrid tie-backs or geosynthetic fabrics (also referred to generally as geogrids and geotextiles) may be used with retaining wall blocks.

The veneers are produced in dimensions that are convenient to manufacture and handle. Convenient veneer sizes are about 4×12 inches (10×30 cm), 6×16 inches (15×41 cm), 8×18 inches (20.5 cm×45.7 cm), 16×48 inches (40.6×121.9 cm), 32×48 inches (81.3×121.9 cm), 2 feet by 4 feet (61×122 cm), 4 feet by 8 feet (122×244 cm), and 2 feet by 8 feet (61×244 cm). The larger veneers preferably are made of polymers, especially polymers including fiberglass, etc. The dimensions of the veneer may vary from these stated dimensions in order to meet aesthetic or functional requirements of particular applications.

The back of the veneer is provided with an attachment means so that the veneer can be affixed to a wall or retaining wall block. If the veneer is made of plastic, a desired attachment means can be molded into the panel when it is formed. The desired attachment means can be attached by adhesive or attached by mechanical means such as screws and bolts. Attachment means include hooks, brackets, connection joints, connection channels, and the like. Preferred attachment mechanisms are described further below.

The invention provides several different embodiments using veneers, including those listed below.

(1) Pre-cast Concrete Veneer Facing Attached to a Dry Cast Concrete Support Block In one embodiment, a pre-cast concrete veneer facing is attached to a dry cast concrete support block with a connection device. Connection slots are molded into the block.

(2) Pre-cast Concrete Veneer Facing Attached to a Wet Cast Concrete Support Block In another embodiment, a pre-cast concrete veneer facing is attached to a wet cast concrete support block by integral cast.

(3) Real Stone Veneer Facing Attached to a Dry Cast Concrete Support Block

In another embodiment, a real stone veneer facing is attached to a dry cast concrete block with a connection device. Connection slots are molded into the block. Real stone veneers are typically constructed by attaching stones into a plastic support tray. The tray with the stones then becomes the real stone veneer.

Stone has good compression qualities but is weak in tension. The stone is quite brittle by itself because it usually is thin in section to minimize the weight and cost of the stone. The plastic support tray acts as the tensile element. Once they are glued together, the stone and support tray from a "stressed skin" or diaphragm structure, where they combine the compression and tension elements to form a strong structure.

(4) Real Stone Veneer Facing Attached to a Wet Cast Concrete Support Block

In one embodiment, a real stone veneer facing is attached to a wet cast concrete support block by integral cast.

(5) Polymer Veneer Facing Attached to a Dry Cast Concrete Support Block

In another embodiment, a polymer veneer is attached to a dry cast concrete support block with a connection device. Connection slots are molded into the block. In one embodiment, the polymer veneer has the appearance of stone or rock.

(6) Polymer Veneer Facing Attached to a Wet Cast Concrete Support Block

In one embodiment, a polymer veneer facing is attached to a wet cast concrete support block by integral cast. In one embodiment, the polymer veneer has the appearance of stone or rock.

(7) Polymer Panels Attached to Wall of Retaining Wall Blocks

In one embodiment, polymer panels are attached to a wall made of retaining wall blocks having non-textured smooth faces. The polymer panels are attached with separate connection devices. The panels have integral connection attachment points or attachment devices. The polymer panels are larger than the individual retaining wall blocks. In one embodiment, the individual retaining wall blocks are aligned and the larger veneers are slid into the retaining wall blocks. The veneers can also vary in size in a single wall.

(8) Polymer Pieces Used to Build Veneers On Any Structure

In one embodiment, polymer pieces can be used as individual elements to build veneers on almost any interior or exterior structure.

(9) Exterior or Interior Siding Veneers

In one embodiment, exterior or interior siding veneers can be used on exterior or interior walls. The veneers could be tile, brick, stone, polymer made to look like stone, etc.

Additional embodiments are described herein.

The veneers of the invention can comprise a mineral aggregate in fiberglass. This material is produced by mixing stone particles, sand, or mineral with resin, and pouring this mixture into a mold. Typically, particles of the type of stone that the veneer is meant to resemble are used in the resin mixture, and these particles provide the color for the veneer. For example, if the veneer is intended to resemble natural granite, then granite particles are used in the mix. If limestone is the desired look, then fine particles of limestone may be used.

Various powdered pigments may be added to the mix in order to create different colors or shades of color. The mold is configured to impart a surface texture to the material that resembles the texture of natural stone. After the mineral resin mix is added and spread across the mold, a mixture of glass fibers and resin is added to the back side of the intended object in the mold. At this stage, structural components used to attach the veneer to the surface that is being veneered may be added. Such components may be formed of pultruded fiberglass, and may be attached to the veneer during the curing process in order to create a bond between the veneer and the structural component. After the resin has cured, the front surface of the veneer preferably is sandblasted to remove resin from the surface, thus revealing a naturally-appearing mineral or stone surface. Alternatively, the front surface may by polished in order to produce a polished stone look. Veneers of different colors can be combined to form an aesthetically pleasing wall.

The invention provides a combination comprising a wall block and a veneer. The wall block has a front face, the front face has a block connection space, the veneer has a front face, and the veneer has a veneer connection portion. The veneer is attached to the front face of the wall block by the veneer connection portion, which is disposed in the block connection space.

In an embodiment of the invention, the front face of the veneer is the same size as the front face of the wall block. In another embodiment, the front face of the veneer is larger than the front face of the wall block.

In an embodiment of the invention, the veneer has a top lip. The front face of the veneer can be the same size as the front face of the wall block or can be larger than the front face of the wall block. The veneer can have two side lips.

In an embodiment, the veneer connection portion and the block connection space form a dovetail connection.

In embodiments of the invention, the veneer can be a precast concrete veneer and the wall block can be a dry cast concrete wall block or a wet cast concrete wall block. In embodiments of the invention, the veneer is a real stone veneer and the wall block can be a dry cast concrete wall block or a wet cast concrete wall block.

In embodiments of the invention, the veneer is made of polymer and the wall block can be a dry cast concrete wall block or a wet cast concrete wall block.

In an embodiment of the invention, the wall block has an open space. In an embodiment, the wall block has a rear face, the rear face has a block connection space, and the combination of the wall block and the veneer further comprises a second veneer attached to the rear face of the wall block.

In an embodiment, the veneer connection portions comprise friction fins. In an embodiment, the block connection space is in the shape of a cylinder, trapezoidal column, hexagonal column, or keyhole-shaped column. In an embodiment, the wall block comprises two or more wall block connection spaces. In an embodiment, the wall block comprises two wall block connection spaces and in another embodiment, the wall block comprises three wall block connection spaces. In an embodiment, the veneer connection portion can be slid into the block connection space. In another embodiment, the veneer connection portion can be snapped into the block connection space.

The invention provides a combination comprising a wall block, a veneer, and a connector. The wall block has a front face, the front face has a block connection space, the veneer has a front face, and the veneer has a veneer connection space. The veneer is attached to the front face of the wall block by the connector, which is disposed in the block connection space and in the veneer connection space.

In an embodiment, the front face of the veneer is the same size as the front face of the wall block, and in another embodiment the front face of the veneer is larger than the front face of the wall block. In an embodiment, the block connection space and the veneer connection space are in the shape of a cylinder, trapezoidal column, hexagonal column, or keyhole-shaped column. In an embodiment, the wall block has a rear face, the rear face has a block connection space, and the combination further comprises a second veneer attached to the rear face of the wall block. In an embodiment, the connector comprises friction fins.

The invention provides a combination comprising a wall block and a veneer. The wall block has a front face and a top face, the top face has a block connection space, the veneer has a front face, and the veneer has a veneer connection portion. The veneer is disposed adjacent the front face of the wall block and the veneer is attached to the top face of the wall block by the veneer connection portion, which is disposed in the block connection space. In an embodiment, the front face of the veneer is the same size as the front face of the wall block, and in another embodiment, the front face of the veneer is larger than the front face of the wall block.

The invention provides a real stone veneer comprising a tray having veneer connection portions. The real stone is attached to the tray with an adhesive, and the tray comprises holes that contain adhesive. In an embodiment, the holes are tapered towards the real stone. In an embodiment, the holes are rivet-shaped having a narrower diameter portion and a wider diameter portion, and the narrower diameter portion of the rivet shape is adjacent to the real stone.

The invention provides a real stone veneer comprising a tray having veneer connection portions. The real stone is attached to the tray with an adhesive, and the tray comprises wells that contain adhesive.

The invention provides a real stone veneer comprising a tray having veneer connection portions. The real stone is attached to the tray with an adhesive, and the tray comprises a honeycomb structure that contains adhesive.

The invention provides walls comprising any of the combinations comprising a wall block and a veneer that are described herein.

The invention provides a wall comprising two or more wall blocks and two or more veneers. The wall blocks have front faces, the front faces have block connection spaces, the veneers have front faces, and the veneers have veneer connection portions. The veneers are attached to the front faces of the wall blocks by the veneer connection portions which are disposed in the block connection spaces. The veneers have front faces of at least two different sizes.

The invention provides a wall comprising two or more wall blocks and two or more veneers. The wall blocks have front faces, the front faces have block connection spaces, the veneers have front faces, and the veneers have veneer connection portions. The veneers are attached to the front faces of the wall blocks by the veneer connection portions which are disposed in the block connection spaces. The veneers have front faces of at least two different colors.

The invention provides a wall comprising two or more wall blocks, two or more veneers, and two or more connectors. The wall blocks have front faces, the front faces have block connection spaces, the veneers have front faces, and the veneers have veneer connection spaces. The veneers are attached to the front faces of the wall blocks by the connectors which are disposed in the block connection spaces and the veneer connection spaces. The veneers have front faces of at least two different sizes.

The invention provides a wall comprising two or more wall blocks, two or more veneers, and two or more connectors. The wall blocks have front faces, the front faces have block connection spaces, the veneers have front faces, and the veneers have veneer connection spaces. The veneers are attached to the front faces of the wall blocks by the connectors which are disposed in the block connection spaces and the veneer connection spaces. The veneers have front faces of at least two different colors.

The invention provides a wall comprising two wall blocks and a veneer, the wall blocks having front faces, the front faces having block connection spaces, the veneer having a front face, the veneer having a veneer connection portion, the veneer being attached to the front faces of the wall blocks by the veneer connection portion, and the front face of the veneer having a larger area than the combined area of the front faces of the two wall blocks.

The invention provides a combination comprising a first wall block, a second wall block, and a tensile connector. Each wall block has a front face and a rear face, and the front face and the rear face each having a block connection space. The first wall block being connected to the second wall block by a tensile connector, which is disposed in the block connection spaces in the rear faces of the first and second blocks. In an embodiment, veneers are attached to the front faces of the first and second blocks. The invention provides a wall comprising this combination of a first wall block, a second wall block, and a tensile connector.

The invention provides a combination comprising a wall and two or more cast polymer veneers attached to the wall. In an embodiment, the veneers are attached to each other by tongue and groove.

The invention provides a wall comprising wire face elements and veneers attached to the wire face elements. In an embodiment, the front faces of the veneers are the same sizes as front faces of the wire face elements. In an embodiment, the wire face elements have front faces having a dimension of at least 0.6×1.2 m.

The invention provides a wall comprising wire baskets and veneers attached to front faces of the wire baskets. In an embodiment, the wire baskets contain rock. In an embodiment, the front faces of the veneers are the same sizes as front faces of the wire baskets. In an embodiment, the wire baskets have front faces having a dimension of at least 0.6×1.2 m.

The invention provides a wall block having a front face, the front face comprising two or more wall block connection spaces. In an embodiment, the front face comprises three or more wall block connection spaces.

Turning now to the Figures, the veneers of this invention are shown and described.

FIG. 1 shows a retaining wall block 10 with a veneer 20. FIG. 1 is a perspective bottom view of the retaining wall block 10 with veneer 20. Veneer 20 has front face 25. Retaining wall block 10 has a connection knob 30 and open space 40. Connection knob 30 can be replaced with a connection pin. The connection pin can be made of plastic. Retaining wall block 10 has block connection spaces 60 and the veneer has veneer connection portions 50. The block connection space 60 and veneer connection portions 50 form a dovetail joint. Any appropriate connection system can be used.

The retaining wall block 10 can be made of any appropriate material. Appropriate materials include wet cast concrete, dry cast concrete, plastic, etc. The wall block has a front face, a rear face, two side faces, and a top and bottom face. The veneer 20 can be made of any appropriate material. The veneer has a front face, a rear face, two side faces, and a top and bottom face. Appropriate materials include a pre-cast concrete veneer, polymer veneer, real stone veneer, etc. The veneers can be sold already placed on the retaining wall blocks or added as a wall is built.

Figure 2:
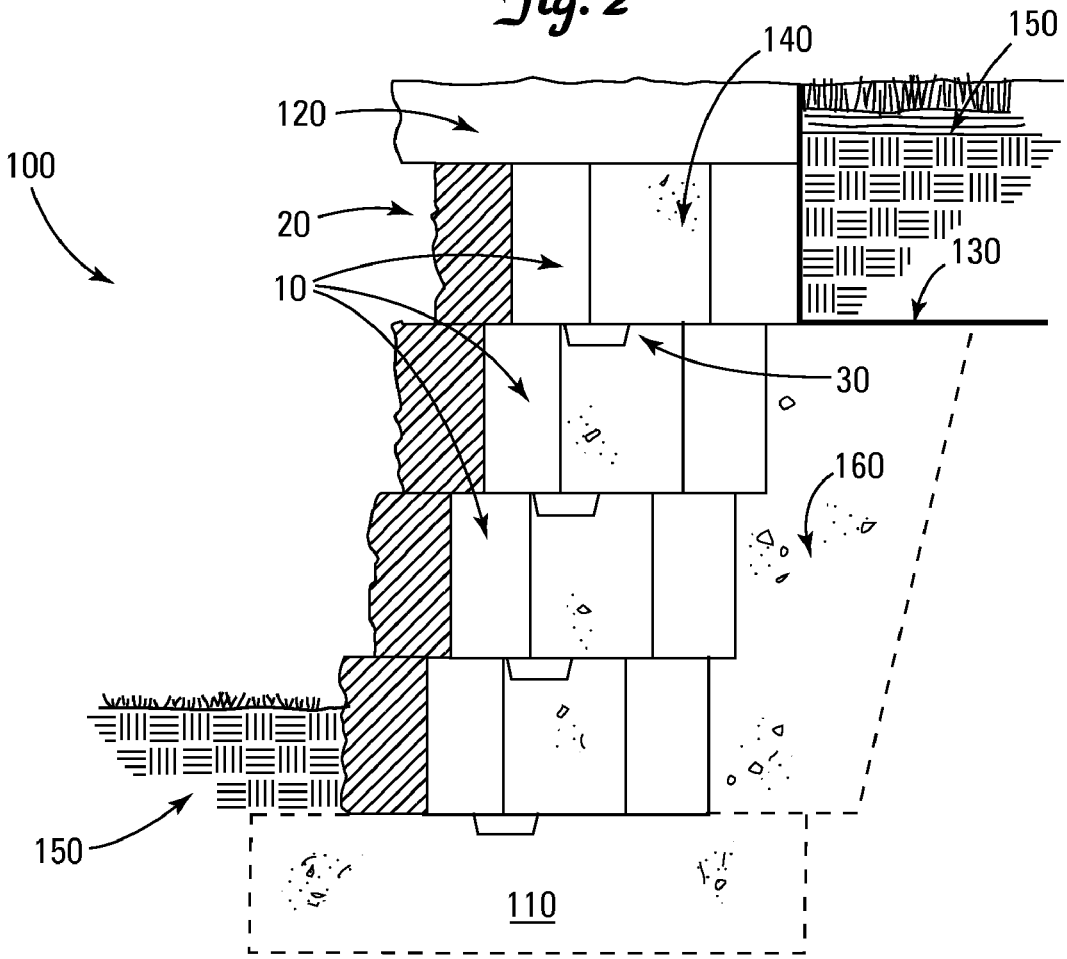
FIG. 2 is a cross-sectional view of a retaining wall.

FIG. 2 shows a retaining wall 100 built with the retaining wall block 10 with veneer 20. The retaining wall 100 is built on leveling pad 110. FIG. 2 shows a retaining wall built of four courses of retaining wall block, with a cap unit 120. Preferably, each course of retaining wall blocks is set back approximately 0.75 inch (1.9 cm) from the lower course. The set back could range from 1 to 10 degrees. The cap unit 120 is not set back and has an overhang over the lower course. Connection knobs 30 are inserted into a block on the lower course and help to maintain the stability of the wall. Gravel 140 or other aggregate material is poured into the open spaces 40 before the cap unit 120 is placed in the wall. A filter cloth or barrier 130 can be placed as shown between the soil 150 and the wall. A drainage zone 160 of gravel or other material can be placed behind the wall. Connection pins could be used in place of connection knobs 30.

FIGS. 3 to 6 show a retaining wall block 210 with a veneer 220. FIG. 3 is a cross-sectional view of the block 210 and veneer 220 and FIG. 4 is a bottom view of the block 210 and veneer 220. Veneer 220 has front face 225. Retaining wall block 210 has a connection knob 230 and open space 240. Connection knob 230 can be replaced with a connection pin. The connection pin can be made of plastic, pultruded fiberglass or other materials. Retaining wall block 210 has block connection spaces 260 and the veneer has veneer connection portions 250. The block connection spaces 260 and veneer connection portions 250 from dovetail joints. Any appropriate connection system can be used. In this embodiment, the veneer connection portions 250 are connection clips made of polymer.

As shown in FIG. 3, the veneer 220 has a top lip 270 and this top lip 270 is received into a recessed portion 280 of the wall block 210. The top lip 270 provides a three-dimensional stone appearance on the top of the block surface due to the greater depth of the top lip 270. Since the wall block 210 may be used to build a wall with a set-back, the top lip allows all exposed surfaces to have the look of a three-dimensional stone. As shown in FIGS. 4 to 6, the veneer 220 has side lips 300 and these side lips 300 are received into recessed portions 310 of wall block 210. As shown in FIGS. 3 to 5, the wall block 210 has an indented face 290 that receives the veneer 220. The veneer 220 can be added to the block during manufacture of the block, immediately before using the block, after the block has been placed in a wall, or at any other appropriate time. Veneer 220 can be slid into wall connection spaces 260. In addition to having a top lip 270, the veneer could also have a bottom lip (not shown) that is received into a recessed portion (not shown) of wall block 210. The veneer would then be snapped in to the block instead of slid into the block.

The retaining wall block 210 can be made of any appropriate material. Appropriate materials include wet cast concrete, dry cast concrete, plastic, etc. The veneer 220 can be made of any appropriate material. Appropriate materials include a pre-cast concrete veneer, polymer veneer, real stone veneer, etc. The block 210 and veneer 220 can be used to build a retaining wall as described above in the description of FIG. 2.

Figure 7:
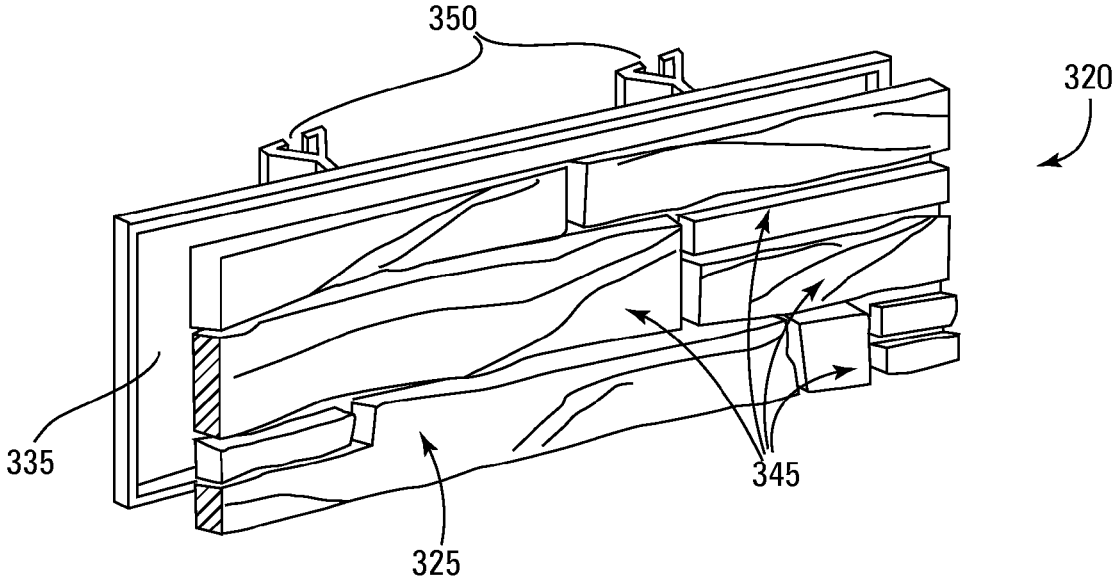
FIG. 7 is a perspective view of a veneer.

FIG. 7 shows a veneer 320 made of real stone. Veneer 320 has front face 325 and veneer connection portions 350. Veneer connection portions 350 are attached to tray 335. In FIG. 7 the stones 345 are shown offset from the tray 335. The stones 345 have not yet been attached to the tray 335. Real stones 345 are attached to the tray 335, using an appropriate adhesive. Appropriate adhesives include epoxy, polyurethane adhesives, methacrylate adhesives, etc. The real stones 345 preferably are 0.75 inch (1.9 cm) to 1 inch (2.5 cm) thick. The veneer 320 preferably has front faces with dimensions of 12 inches (30 cm) in width by 4 inches (10 cm) in height, 16 inches (41 cm) in width by 6 inches (15 cm) in height, or 18 inches (46 cm) in width by 8 inches (20 cm) in height. The veneer 320 is attached to a retaining wall block and used as described herein. The veneer 320 can have a top lip or a top and bottom lip as described above in connection with FIGS. 3 to 6. The lips preferably are made of real stone. Natural stone is dense and generally heavy compared to polymers or fiberglass. Due to this a thin profile of stone is desired to minimize weight. A depth of 0.75 inch (1.9 cm) allows for depth of joints and stone character and provides pleasing aesthetics.

Figure 8:
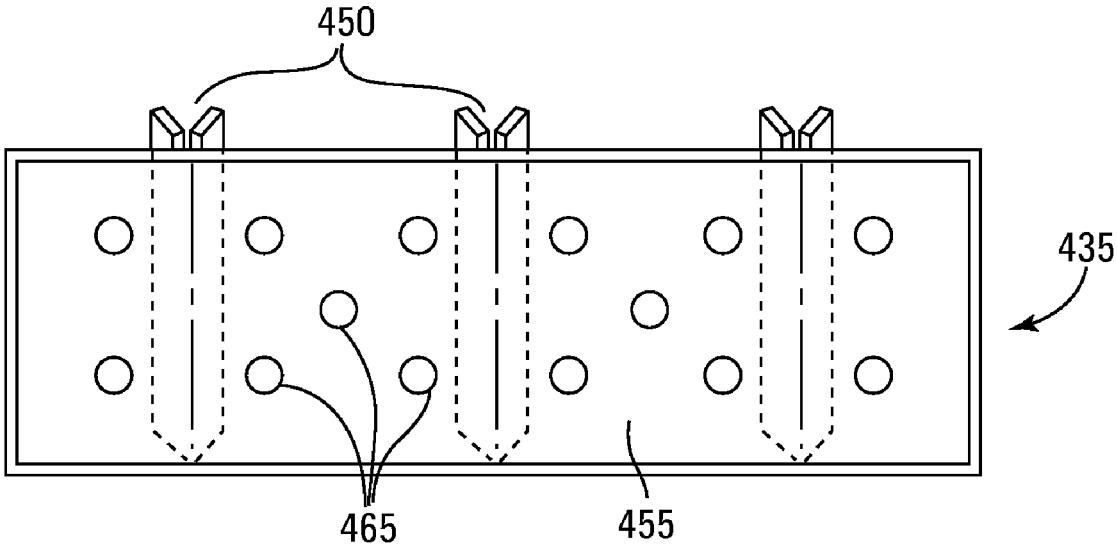
FIG. 8 is a perspective view of a tray.

FIG. 8 shows a tray 435 having veneer connection portions 450. The tray 435 preferably is made of plastic. Tray 435 has holes 465 in the base 455 of the tray. Slots could also be used in place of holes 465 or a combination of holes and slots could be used. The tray 435 is used to hold real stones and make a veneer similar to that described above in connection with FIG. 7. The holes 465 help to strengthen the attachment of the veneer to the tray because they allow adhesive to form a better attachment to the tray than a tray with just a flat base. Instead of holes, the tray could have wells to contain adhesive. The holes/slots 465 can be tapered such that the set adhesive locks into the tray and cannot pull out in a forward direction toward the veneer.

Holes allow adhesive to seep through the tray. When the adhesive has set and hardened, the stone is attached to the adhesive and the adhesive is mechanically prohibited from pulling through the holes in the tray. This attachment is somewhat like a riveted connection. This is significant because most adhesives do not bond well to a polymer tray.

Figure 9:
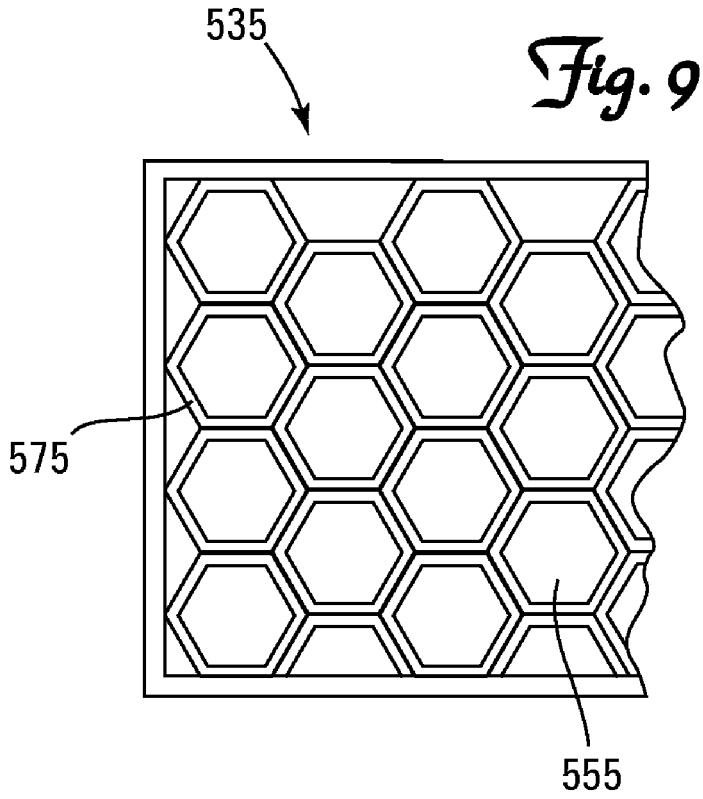
FIG. 9 is a perspective view of a tray.
Figure 10:
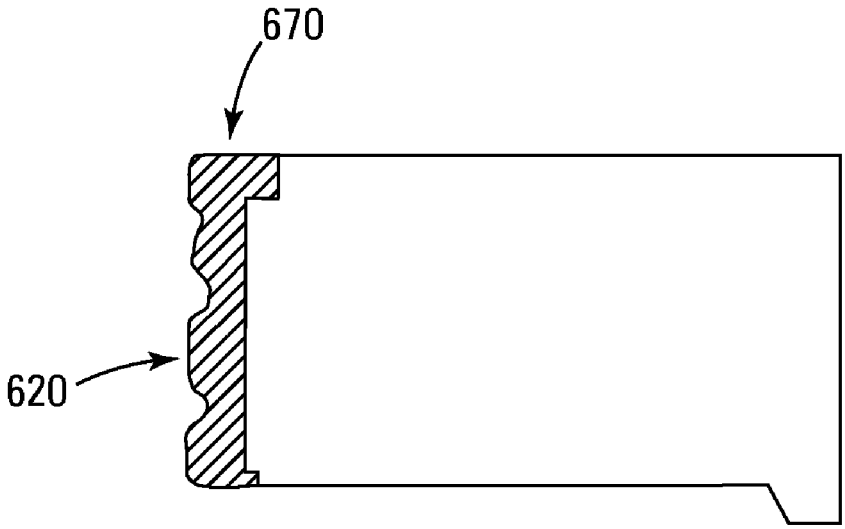
FIG. 10 is a side view of a real stone veneer and a retaining wall block.

FIG. 9 shows a portion of a tray 535 similar to the tray of FIG. 8. The tray 535 has a raised honeycomb structure 575 that acts as strength ribs to add greater support to the veneer tray. They can also serve a purpose similar to the holes 465 of FIG. 8. FIG. 10 shows a real stone veneer 620 having a top lip 670.

Figure 11:
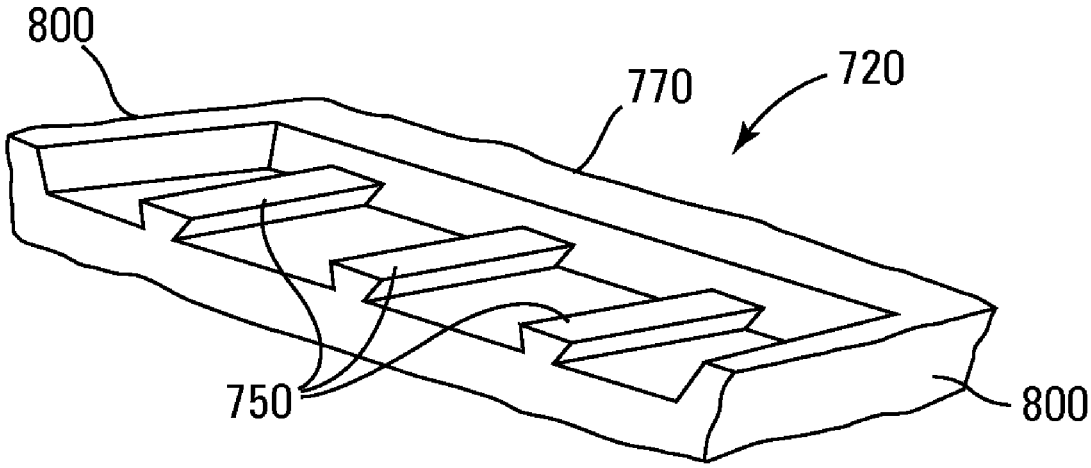
FIG. 11 is a perspective view of a veneer.

FIG. 11 shows a veneer 720 similar to the veneer of FIG. 6. Veneer 720 has veneer connection portions 750, top lip 770, and side lips 800. Veneer 720 can be slid into the veneer connection portions of an appropriate wall block. For example, the block of FIGS. 3 to 5 can be used.

FIG. 12 shows a veneer 920 with a top lip 970 and a bottom lip 975.

FIG. 13 shows a veneer 1020 with veneer connection portions 1050 that are meant to be snapped or pushed into openings in the block instead of sliding in. Veneer connection portions 1050 have friction fins 1055 that help insure the veneer remains connected.

FIGS. 14 and 15 show a retaining wall block 1110 with a veneer 1120. The embodiment of FIGS. 14 and 15 is similar to the embodiment of FIGS. 3 to 6 except that there are no side lips. Retaining wall block 1110 has block connection spaces 1160 and the veneer 1120 has veneer connection portions (not shown). The veneer 1120 has top lip 1170 and this top lip 1170 is received into a recessed portion 1180 of wall block 1110.

FIGS. 16A to 16D show a variety of different wall block connection spaces. FIG. 16A shows dovetail wall block connection space 1260*a*. FIG. 16B shows round wall block connection space 1260*b*. FIG. 16C shows hexagonal wall block connection space 1260*c*. FIG. 16D shows T-shaped wall block connection space 1260*d*.

FIG. 17 shows dovetail wall connection space 1260*a* and dovetail veneer connection portion 1250*a*. Veneer connection portion 1250*a* is in the form of springing wings that are compressed in use to hold the veneer connection portion in place. FIG. 17 also shows holding fins 1257*a* disposed on anchoring portion 1258*a*, which is attached to veneer connection portion 1250*a*. Holding fins 1257*a* and anchoring portion 1258*a* are disposed within veneer 1220*a* (not shown). Holding fins 1257*a* and anchoring portion 1258*a* preferably are placed within veneer 1220*a* before the veneer is attached to the retaining wall block 1210*a*. For example, a concrete or polymer veneer 1220*a* can be formed around the holding fins 1257*a* and anchoring portion 1258*a*. Alternatively, holding fins 1257*a* could be friction fins and the holding fins 1257*a* and anchoring portion 1258*a* could be snapped into receiving portions in the veneer. All connection elements described in this application can have frictional fins which collapse slightly as the object is inserted into a void. The fins lock up with the surfaces.

FIG. 18 shows a round veneer connection portion 1350 and holding fins 1357 disposed on anchoring portion 1358, which is attached to round veneer connection portion 1350. Holding fins 1357 and anchoring portion 1358 are disposed within veneer 1320 (not shown). The round veneer connection portion 1350 has friction fins 1355. The veneer 1320 can be attached to the veneer connection portion 1350 as in the description of FIG. 17.

FIG. 19 shows round veneer connection portion 1450 and holding fins 1457 disposed in two anchoring portions 1458, which are attached to round veneer connection portion 1450. Holding fins 1457 and anchoring portions 1458 are disposed within veneer 1420 (not shown). The round veneer connection portion 1450 has friction fins 1455. The veneer 1420 can be attached to the veneer connection portion 1450 as in the description of FIG. 17.

FIGS. 20 and 21 show hexagonal veneer connection portions 1550 and holding fins 1557 disposed on anchoring portions 1558, which are attached to hexagonal veneer connection portion 1550. Holding fins 1557 and anchoring portion 1558 are disposed within veneer 1520 (not shown). The hexagonal veneer connection portion has friction fins 1555. The veneer 1520 can be attached to the veneer connection portion 1550 as in the description of FIG. 17.

FIG. 22 shows dovetail veneer connection portion 1650 and holding fins 1657 disposed on anchoring portion 1658, which is attached to dovetail veneer connection portion 1650. Holding fins 1657 and anchoring portion 1658 are disposed with veneer 1620 (not shown). The dovetail veneer connection portion 1650 has friction fins 1655. The veneer 1620 can be attached to the veneer connection portion 1650 as in the description of FIG. 17.

FIGS. 23A to 23D show retaining wall blocks or portions of retaining wall blocks with different wall block connection spaces. FIGS. 23A and 23B show round wall block connection spaces 1760*a* in retaining wall block 1710*a*. FIG. 23C shows dovetail wall block connection spaces 1760*c* in retaining wall block 1710*c*. FIG. 23D shows T-shaped wall block connection spaces 1760*d* in retaining wall block 1710*d*.

FIG. 24A shows retaining wall block 1810 having conical wall block connection space 1860. FIG. 24B shows conical veneer connection portion 1850 having interior open area 1851. Anchoring portion 1858 is attached to conical veneer connection portion 1850. Anchoring portion 1858 is disposed within veneer 1820. Conical veneer connection portion 1850 can be placed into conical wall block connection space 1860. Conical wall block connection space 1860 preferably is smaller than conical veneer connection portion 1850 so that veneer connection portion 1850 will be compressed when placed in wall block connecting space 1860.

FIG. 25 shows a retaining wall block 1910 having wall block connection space 1960 and veneer 1920 having veneer connection portion 1950 and top lip 1970. The veneer is connected to the retaining wall block as shown.

FIG. 26 shows a retaining wall block 2010 having wall block connection spaces 2060 and veneer 2020 having veneer connection portions 2050. The veneer connection portions 2050 are placed into the wall block connection spaces 2060.

FIG. 27 shows a real stone veneer 2120 with triangular veneer connection portions 2150. FIG. 28 shows a real stone veneer 2220 with veneer connection portions 2250 in the form of loops. The veneers of FIGS. 27 and 28 are intended to be used with a wet-cast poured block. The veneer connection portions attach the veneer to the block by this imbedded connection.

Figure 29:
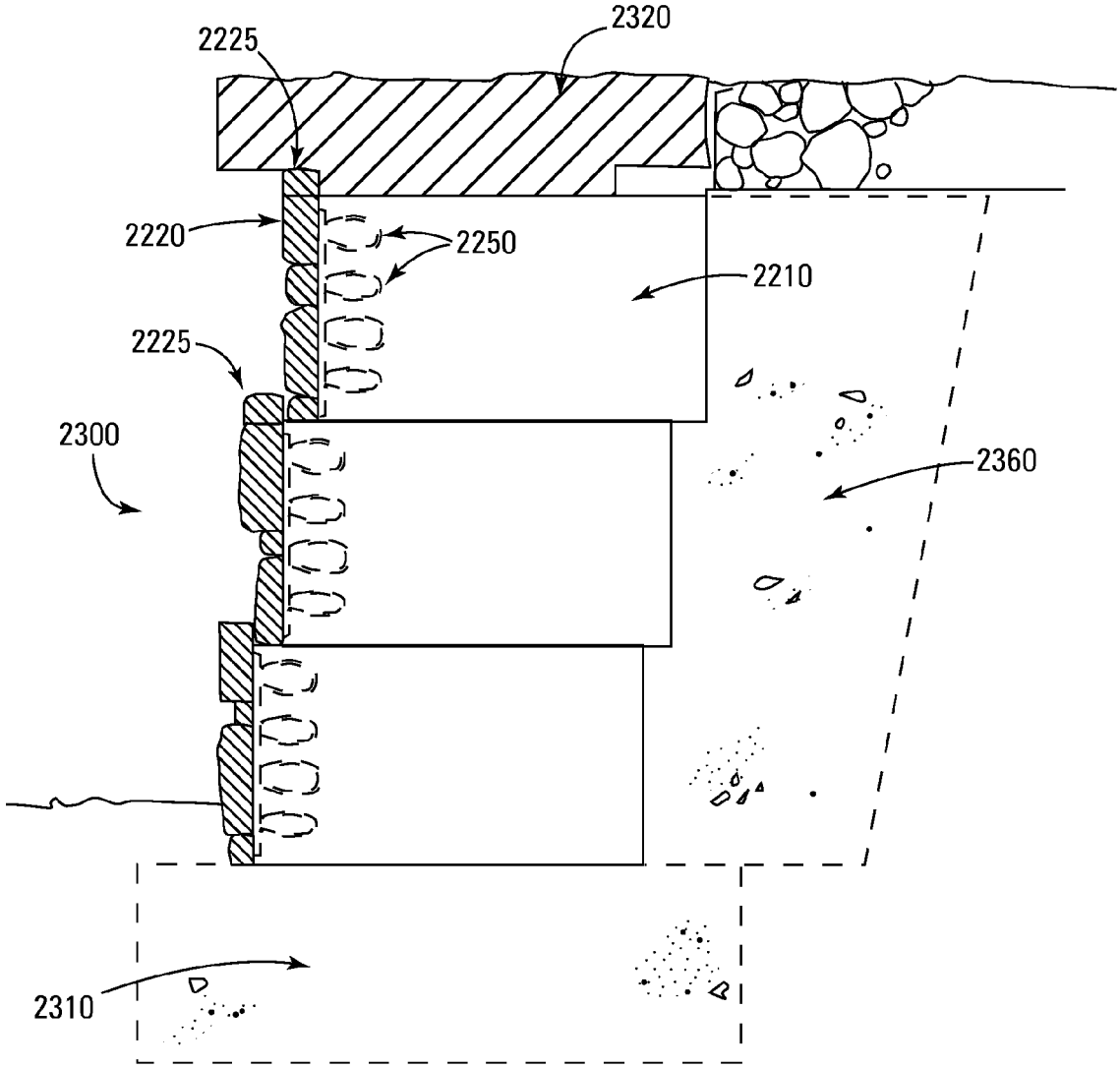
FIG. 29 is a cross-sectional side view of a retaining wall.

FIG. 29 shows a retaining wall 2300 built with retaining wall block 2210 having veneer 2220. The retaining wall 2300 is built on leveling pad 2310. FIG. 29 shows a retaining wall built of three courses of retaining wall block, with a cap unit 2320. Preferably, each course of retaining wall blocks is set back approximately 0.75 inch (1.9 cm) from the lower course. The cap unit 2320 is not set back and has an overhang over the lower course. A drainage zone 2360 of gravel or other material can be placed behind the wall. The veneer connection portions 2250 in the form of loops are disposed in the wall block connection spaces 2260 (not shown, but which are similar to wall block connection spaces 1760*a*). A top lip portion 2225 of the veneer 2220 extends above the top of the retaining wall block 2210.

Figure 31:
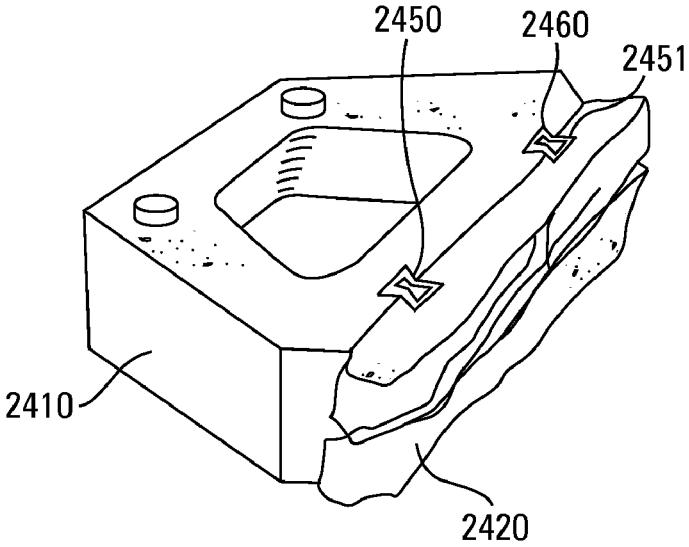
FIG. 31 is a perspective view of a retaining wall block and a veneer.
Figure 30:
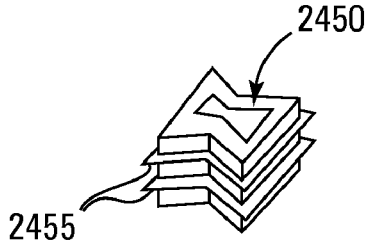
FIG. 30 is a perspective view of a connector.

FIG. 30 shows a connector 2450 having friction fins 2455. FIG. 31 shows a veneer 2420 attached to a retaining wall block 2410 using connectors 2450. The connectors 2450 are disposed within wall block connection spaces 2460 and veneer connection spaces 2451. The friction fins 2455 are relatively pliable so they form a tight connection between the wall block connection spaces and the veneer connection spaces, and can handle the minor tolerance difference between the manufactured veneers and blocks.

Figure 32:
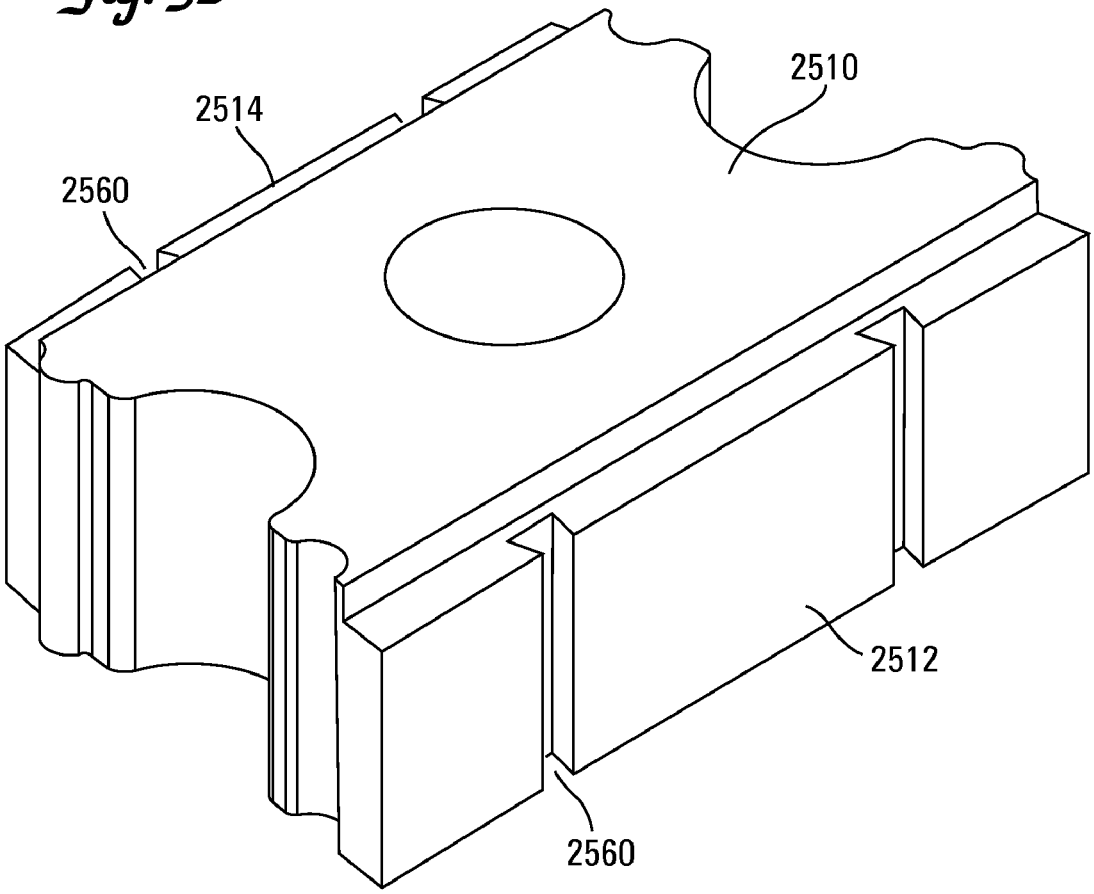
FIG. 32 is a perspective view of a retaining wall block.

FIG. 32 shows a retaining wall block 2510 having a front face 2512 and a back face 2514. Both the front face 2512 and back face 2514 have wall block connection spaces 2560. Veneers can be attached to both the front face 2512 and the back face 2514.

Figure 33:
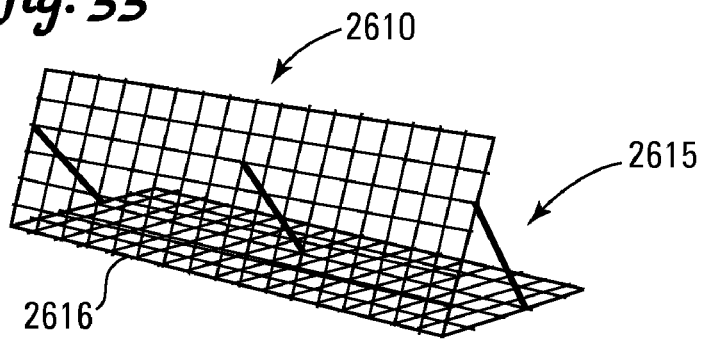
FIG. 33 is a perspective view of a wire face element.

One option to build walls is to use welded wire faces tied to geogrid soil reinforcement. A filter fabric preferably is used to prevent soil from falling through the wire face. FIG. 33 shows a wire face element 2610 having a diagonal brace 2615. The wire face element preferably has a front face 2616 having dimension of 2×4 feet (0.6×1.2 m), 2×6 feet (0.6×1.8 m), or 2×8 feet (0.6×2.4 m), etc.

Figure 34:
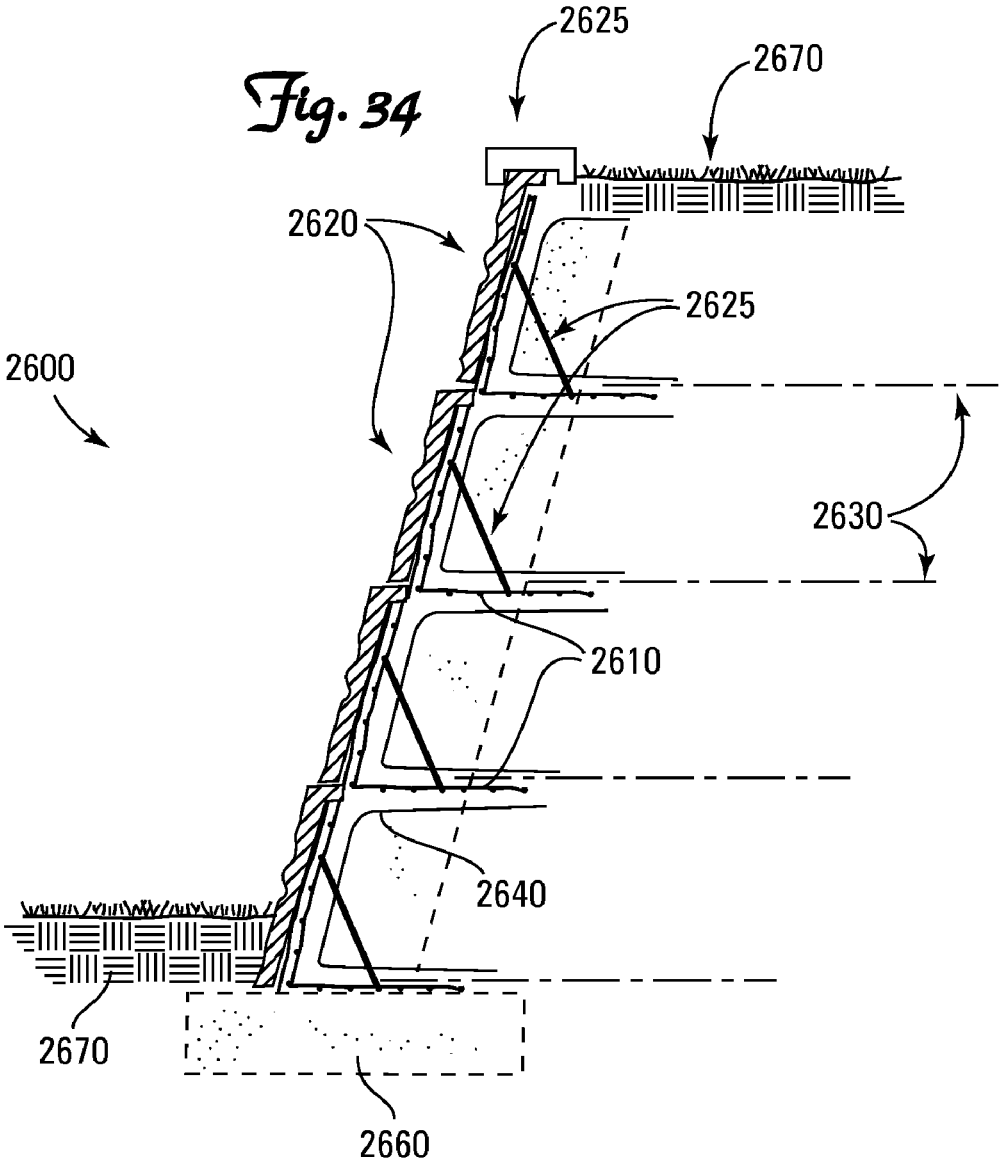
FIG. 34 is a cross-sectional side view of a retaining wall.

FIG. 34 shows a wall 2600 made using wire face elements 2610 and veneers 2620 attached to wall 2600. A cap element 2625 is placed at the top of the wall 2600. Geogrid 2630 used for soil reinforcement and fabric 2640 used to prevent soil from falling through the wire face elements 2610 is used as shown. FIG. 34 also shows soil 2670 and leveling pad 2660.

Figure 35A:
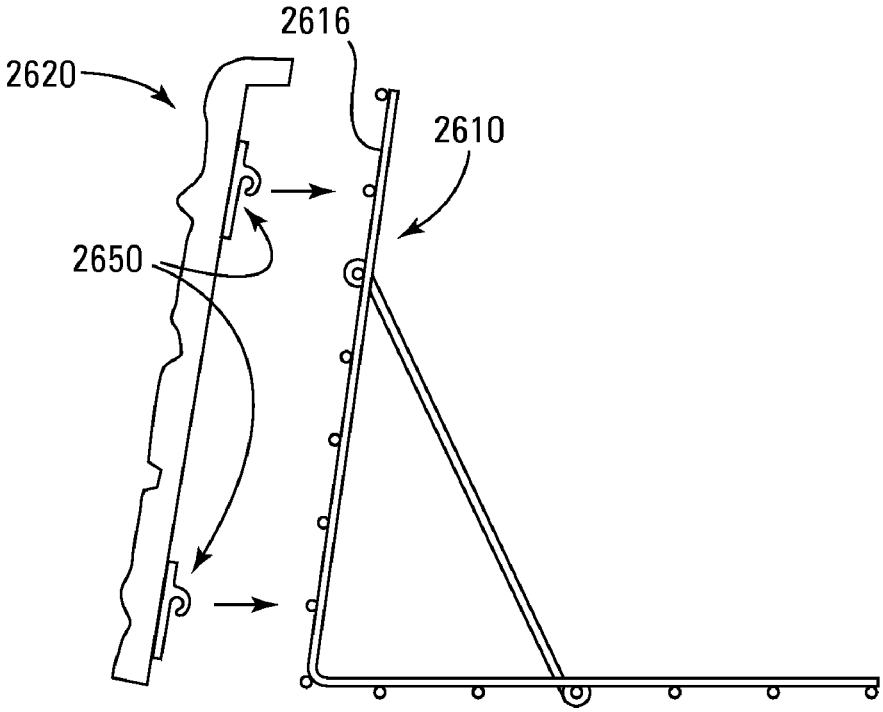
FIG. 35A is a side view of a veneer and a wire face element.
Figure 35B:
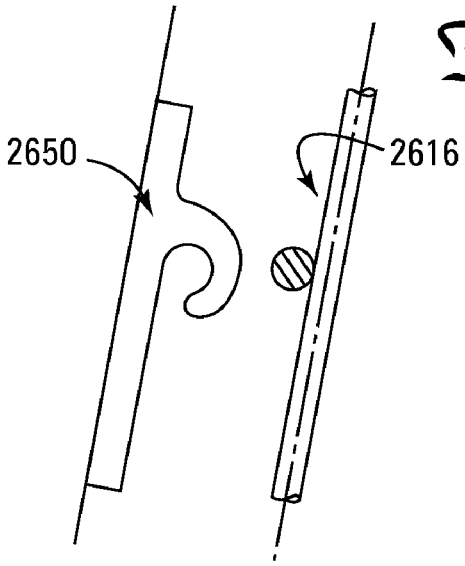
FIG. 35B is a side close-up view of an attachment clip and a wire face element.

FIGS. 35A and 35B show a veneer 2620 with attachment clips 2650 that can be attached to the front face 2616 of a wire face element 2610. FIG. 35B shows a close-up view of an attachment clip 2650 and the front face 2616.

Figure 36A:
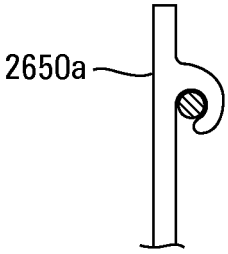
FIGS. 36A to 36D are side views of various attachment clips.
Figure 36B:
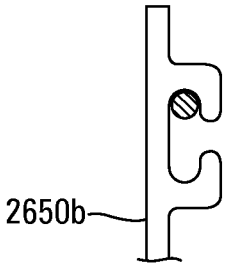
Figure 36C:
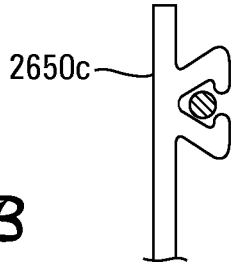
Figure 36D:
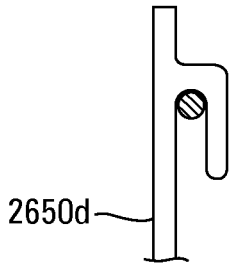
Figure 36E:
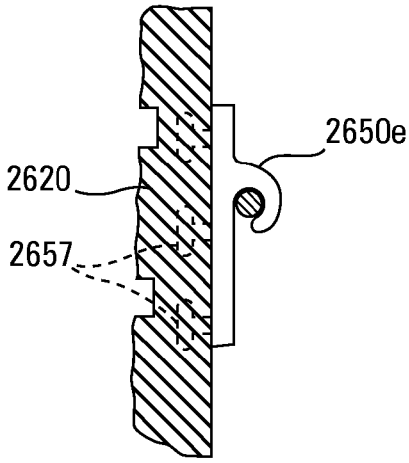
FIG. 36E is a side view of a portion of a veneer and an attachment clip.
Figure 36F:
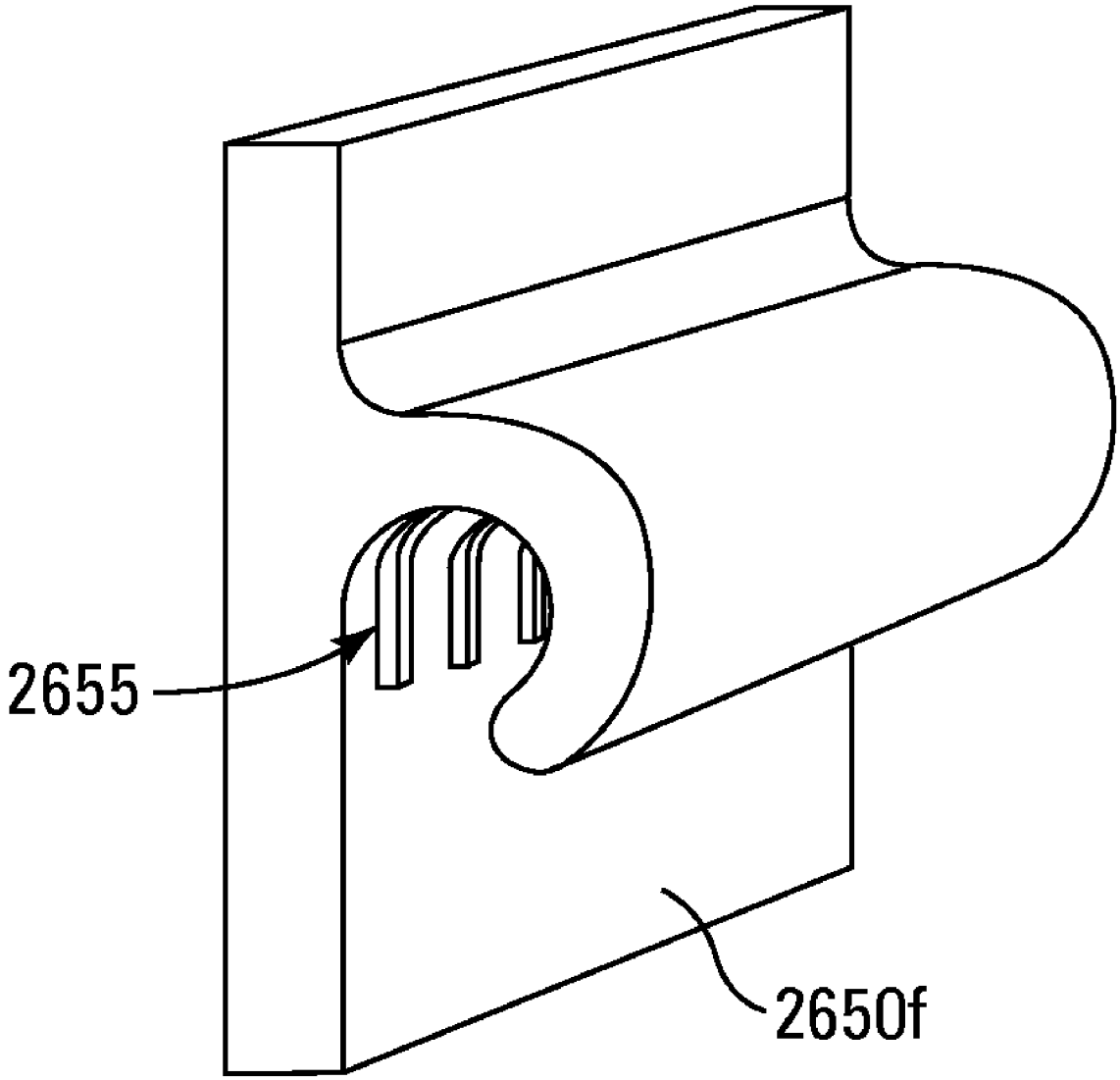
FIG. 36F is a perspective view of an attachment clip.

FIGS. 36A to 36D show various attachment clips (2650*a, b, c, d*) that could be used. The attachment clips shown in FIGS. 36A to 36C have resistance to uplift due to wind. The attachment clip 2650*d* in FIG. 36D does not have resistance to uplift. The attachment clips preferably are made of injection molded plastic, metal, or other elements. The clips preferably can snap over the wire of the front face 2616. Therefore, the clip should flex slightly. The attachment clips 2650 can be attached to the veneer 2620 with adhesive or the clip could have fastening studs 2657 that are embedded into the veneer (see FIG. 36E). In one embodiment, the studs 2657 are formed as part of the attachment clip 2650*e* and embedment takes place during formation of, e.g., a polymer veneer. A typical veneer has a minimum of four attachment clips. The clip could also be provided with friction fins 2655 (see FIG. 36F). The friction fins would prevent rattling or fluttering of the veneer on the wire backing.

Gabions are wire frame baskets. Gabions allow the free flow of water down and out of a wall made of gabions. The gabions are transported to a work site as wire frames and are field assembled into baskets. The baskets are typically 2 to 3 feet (61 cm to 91 cm) wide by 2 to 3 feet (61 cm to 91 cm) deep by 8 to 9 feet (240 cm to 270 cm) long. The baskets are filled with rock at the site and the lid is closed and wired shut. The gabions are then set into place end to end. The gabions can be stacked vertically in a pyramid or triangle shape to hold back the embankment. FIG. 37A shows a gabion 2700 having a lid 2710. FIG. 37B shows a wall 2730 made of gabions 2700. The gabions do not have an aesthetically pleasing appearance and a veneer will improve their appearance. Because gabions have a wire frame similar to the wire face elements above, veneers can be attached to the gabions as described herein.

Figure 38A:
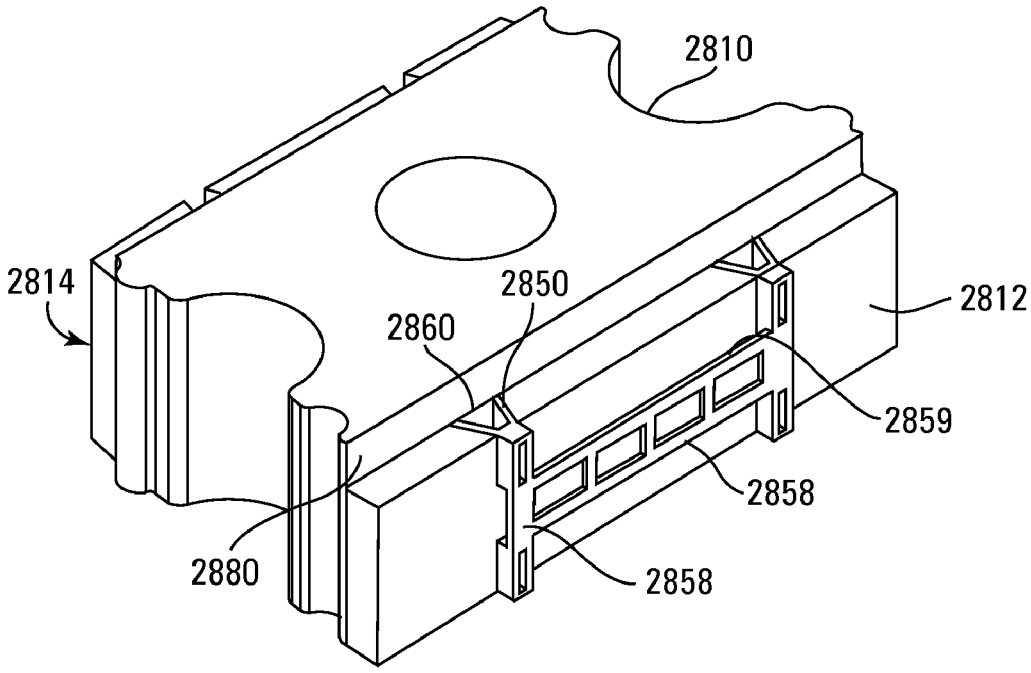
FIGS. 38A and 38B are perspective views of a retaining wall block and a bridge style veneer connection element.
Figure 38B:
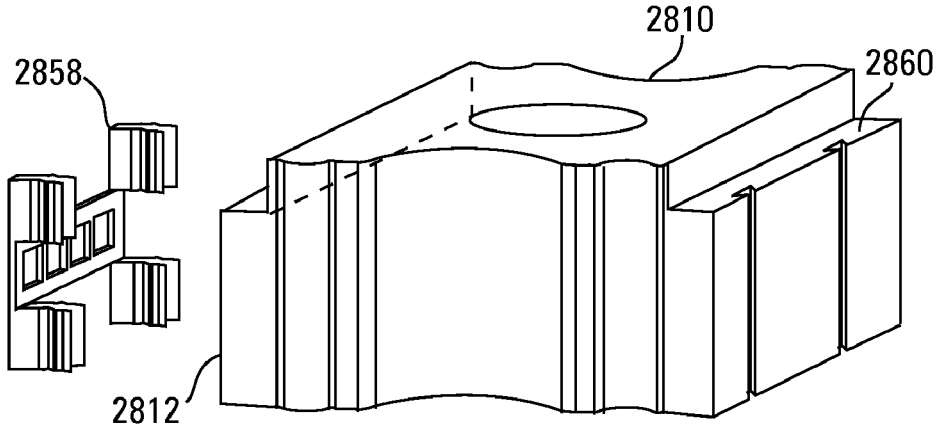

FIGS. 38A and 38B show a veneer bridge connection piece 2859 having dovetail veneer connection portions 2850 and anchoring portion 2858. The anchoring portion 2858 can be embedded in a veneer 2820 (not shown). For example, a concrete or polymer veneer 2820 can be formed around the anchoring portion 2858 so that only the dovetail veneer connection portions 2858 are exposed. In FIG. 38A the veneer connection piece 2859 is shown placed in dovetail wall block connection spaces 2860 of retaining wall block 2810. In use, the bridge connection piece 2859 would be attached to a veneer before being attached to the retaining wall block 2810. The retaining wall block 2810 has a front face 2812 and a back face 2814. Veneers 2820 can be attached to both the front face 2812 and the back face 2814. The retaining wall block 2810 has a recessed portion 2880 for the top lip 2870 of the veneer 2820 (not shown). The front face and the back face can have different dimensions. In one embodiment, the front face is 12 inches wide×4 inches tall (30 cm wide×10 cm tall) and the back face is 9 ⅜ inches wide by 4 inches tall (24 cm wide×10 cm tall).

Figure 39A:
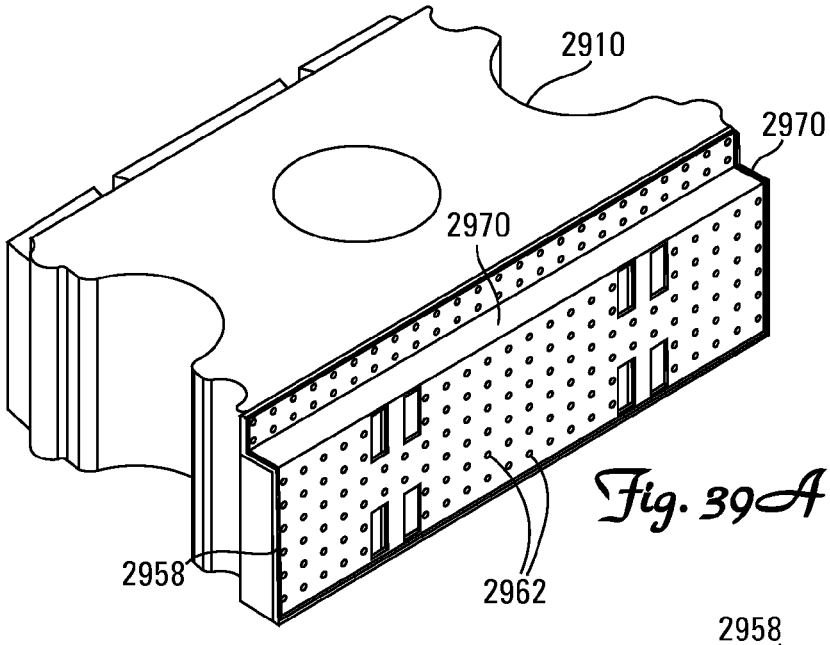
FIGS. 39A and 39B are perspective views of a tray and a retaining wall block.
Figure 39C:
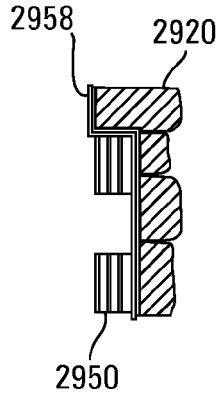
FIG. 39C is a side view of a real stone veneer.

FIGS. 39A and B show a tray 2958 having dovetail veneer connection portions 2950. In FIG. 39A the tray 2958 is shown placed in dovetail wall block connection spaces 2960 of retaining wall block 2910. In use, the tray 2958 would contain real stone veneer 2920 as shown in FIG. 39C.

The retaining wall block 2910 has a front face 2912 and a back face 2914. Veneers 2920 can be attached to both the front face 2912 and the back face 2914. The retaining wall block 2910 has a recessed portion 2980 for the top lip 2970 of the tray 2958. The front face and the back face can have different dimensions. In one embodiment, the front face is 12 inches wide×4 inches tall (30 cm wide×10 cm tall) and the back face is 9 ⅜ inches wide by 4 inches tall (24 cm wide×10 cm tall).

In one preferred embodiment, the tray 2958 will have square holes 2962 on the side of the tray 2958 facing the real stone veneer. These holes will start at a narrow dimension (approximately 3⁄16×3⁄16 inch square holes, 0.19×0.19 cm square holes) then widen to a larger dimension (approximately ¼×¼ inch square holes, 0.10×0.10 cm square holes) as the volume of the holes is a further distance from the real stone veneer. After adhesive is placed in these holes and dries, the dried adhesive provides a positive mechanical connection of the stone veneer 2920 to the tray 2958. These portions of dried adhesive will act like many small rivets with heads formed on the back side of the tray, and the portion of the dried adhesive with a larger dimension will resist being pulled through the narrower opening.

Figure 40:
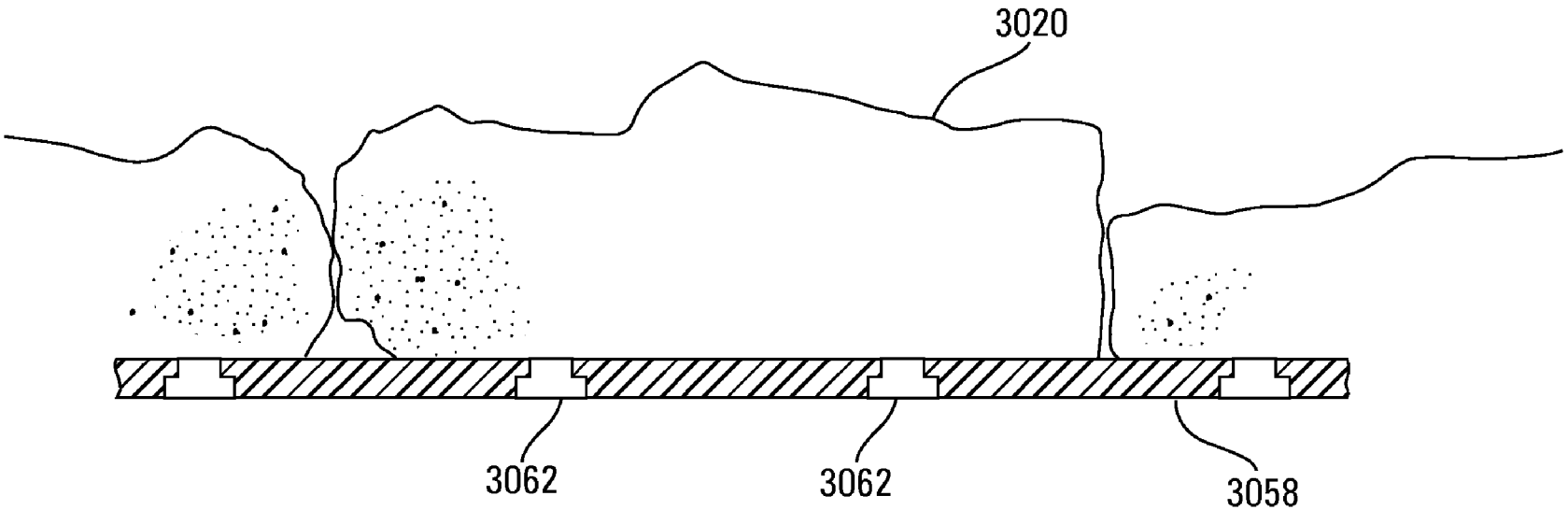
FIG. 40 is a cross-sectional side view of a tray and a real stone veneer.
Figure 41:
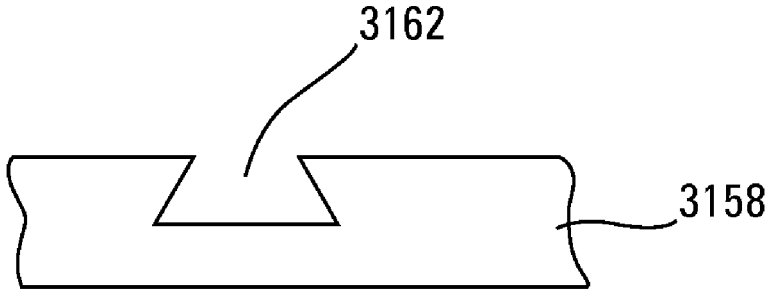
FIG. 41 is a cross-sectional side view of a well in a tray.
Figure 42A:
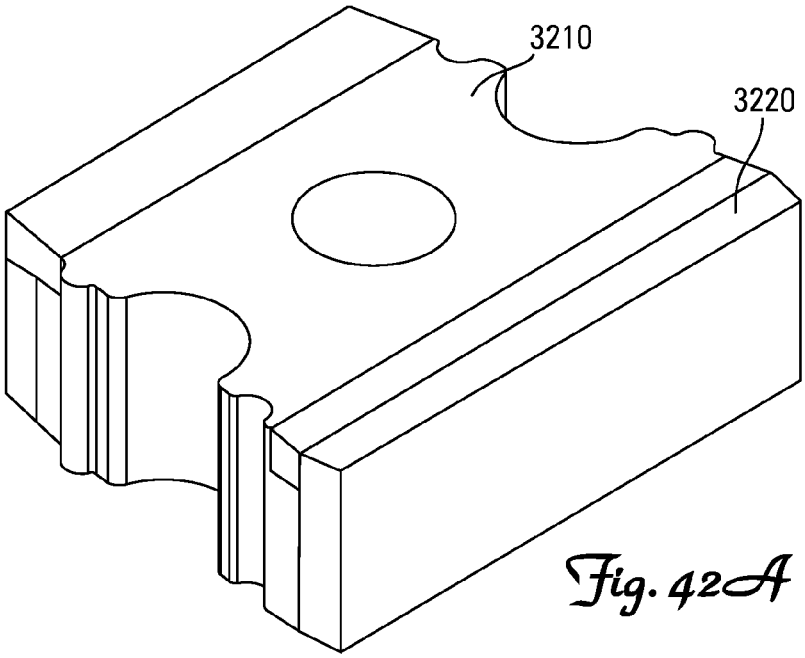
FIGS. 42A and 42B are perspective views of a veneer and a retaining wall block.
Figure 42C:
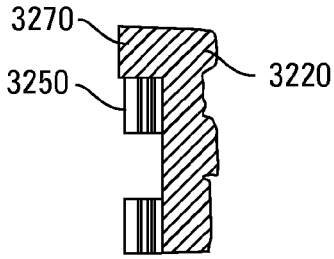
FIG. 42C is a side view of a cast polymer veneer.
Figure 42B:
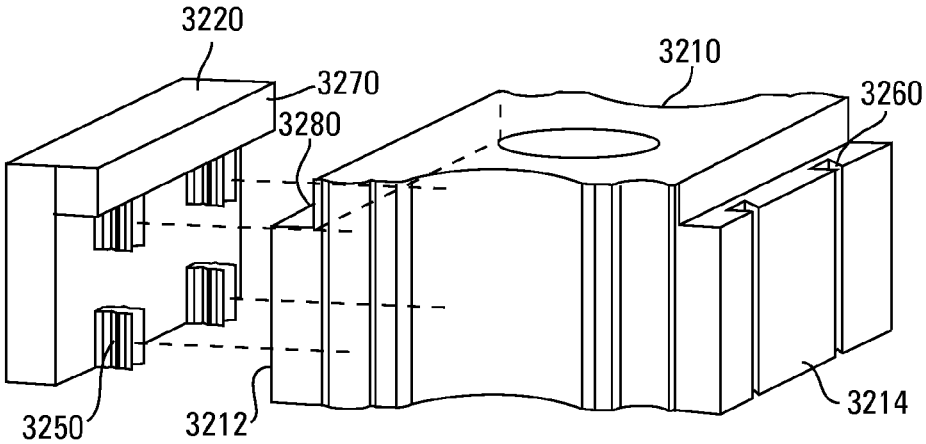

FIG. 40 shows an example of a tray 3058 having holes 3062 with a real stone veneer 3020. The holes 3062 widen to form a rivet-shape. When these holes are filed with adhesive and the adhesive is allowed to dry, the dried, rivet-shaped adhesive is locked into the hole 3062 and is restrained from pulling out of the hole. FIG. 41 shows a well 3162 in a tray 3158. The well 3162 could be used in the same manner as the holes 3062 in FIG. 40. The adhesive collects in the well 3162 and the dried adhesive is restrained from pulling out of the well 3162. FIGS. 42A and B show a cast polymer veneer 3220 having dovetail veneer connection portions 3250. In FIG. 42A the veneer 3220 is shown placed in dovetail wall block connection spaces 3260 of retaining wall block 3210. FIG. 42C shows a side view of the veneer 3220.

The retaining wall block 3210 has a front face 3212 and a back face 3214. Veneers 3220 can be attached to both the front face 3212 and the back face 3214. The retaining wall block 3210 has a recessed portion 3280 for the top lip 3270 of the veneer 3220. The front face and the back face can have different dimensions. In one embodiment, the front face is 12 inches wide×4 inches tall (30×10 cm) and the back face is 9 ⅜ inches wide by 4 inches tall (24×10 cm).

Figure 43:
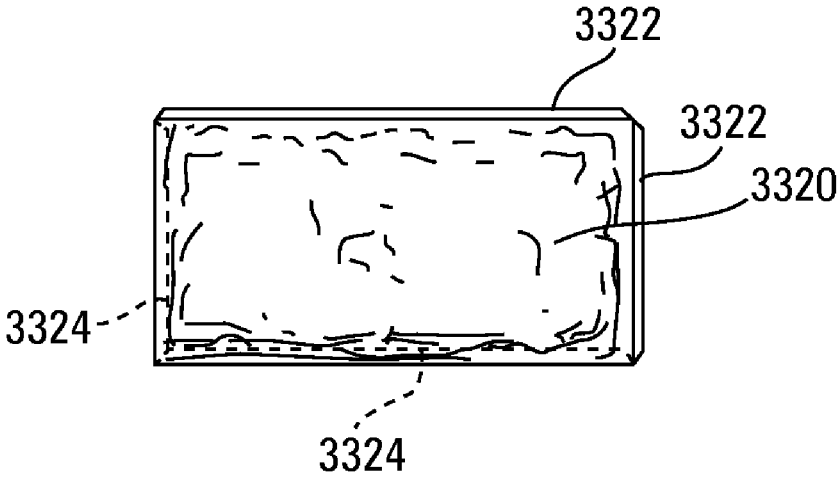
FIG. 43 is a front view of a siding veneer.

FIG. 43 shows an exterior use or interior use siding veneer 3320. The veneer 3320 is a cast polymer veneer and has dimensions of 2×6 feet (0.6×1.8 m). The veneer 3320 has tongues 3322 and grooves 3324 to allow veneers to be attached to each other by tongue and groove. The veneer 3320 can be attached to any type of wall. The veneers can be of any size. Other preferred size include 1×4 feet (0.3×1.2 m), 2×4 feet (0.6×1.2 m), 2×6 feet (0.6×1.8 m), and 2×8 feet (0.6×2.4 m).

Figure 44A:
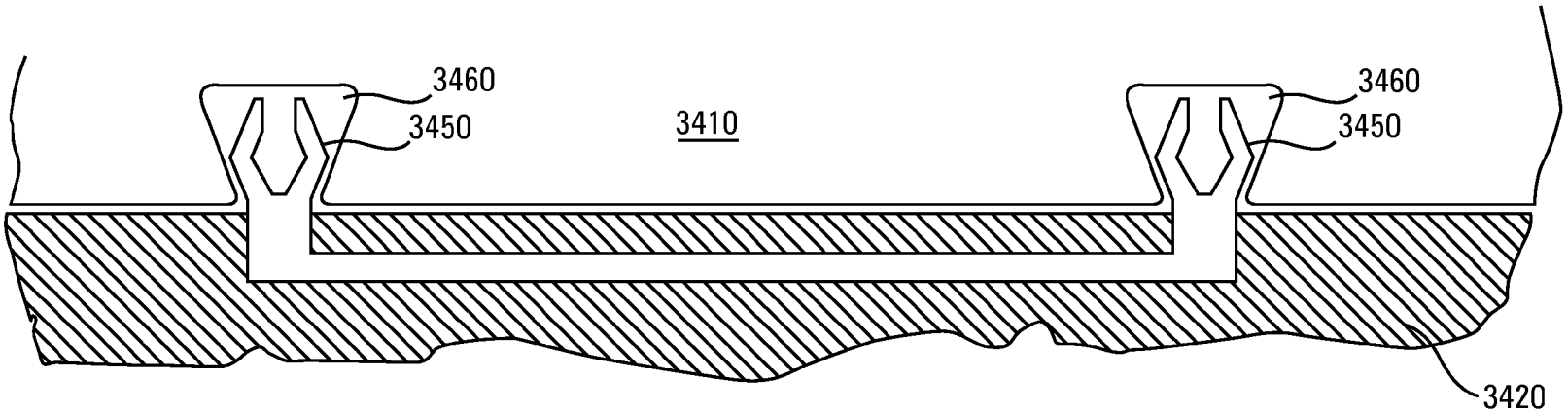
FIGS. 44A to 44C are cross-sectional views of veneer connection portions that can be snapped into place.
Figure 44B:
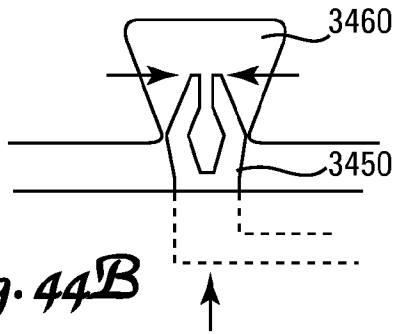
Figure 44C:
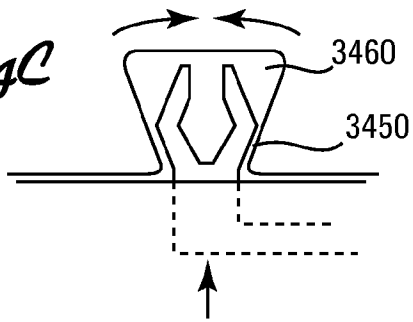

FIG. 44A shows a cast polymer veneer 3420 having veneer connection portions 3450. In FIG. 44A the veneer 3420 is shown placed in wall block connection spaces 3460 of retaining wall block 3410. The veneer connection portions 3450 can be snapped into place. FIG. 44B shows a veneer connection portion 3450 being snapped into place and FIG. 44C shows the veneer connection portion 3450 after it has been snapped into place.

Figure 39B:
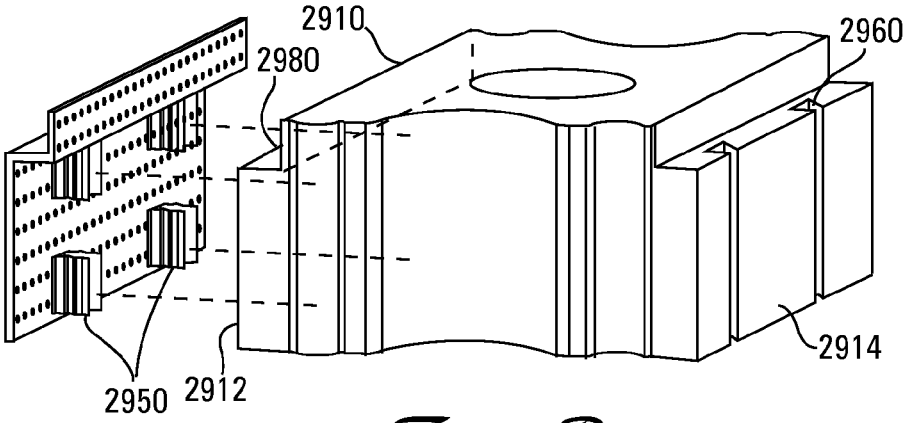

FIGS. 45A to 45D show a tray 3558 similar to the tray of FIGS. 39A and 39B. Tray 3558 has dovetail veneer connection portions 3550. The dovetail connection portions allow for positive connection even during wearing of parts, i.e., change of connection tolerance. The tray 3558 can be placed in dovetail wall block connection spaces 2960 of retaining wall block 2910, as shown in FIGS. 39A and 39B. In use, the tray 3558 would contain real stone veneer 2920 as shown in FIG. 39C.

The retaining wall block 2910 has a front face 2912 and a back face 2914. Veneers 2920 can be attached to both the front face 2912 and the back face 2914. The retaining wall block 2910 has a recessed portion 2980 for the top lip 3570 of the tray 3558. The front face and the back face can have different dimensions. In one embodiment, the front face is 12 inches wide×4 inches tall (30×10 cm) and the back face is 9⅜ inches wide by 4 inches tall (24×10 cm).

In one preferred embodiment, the tray 3558 will have slots 3561 having rounded ends and circular holes 3562 on the side of the tray 3558 facing the real stone veneer. These cylindrical holes will start at a narrow dimension (approximately 3/16 inch in diameter) then widen to a larger dimension (approximately ¼ inch in diameter) as the volume of the holes is a further distance from the real stone veneer. After adhesive is placed in these holes and dries, the dried adhesive provides a positive mechanical connection of the stone veneer 2920 to the tray 3558. These portions of dried adhesive will act like many small rivets with heads formed on the back side of the tray, and the portion of the dried adhesive with a larger dimension will resist being pulled through the narrower opening.

Figure 45A:
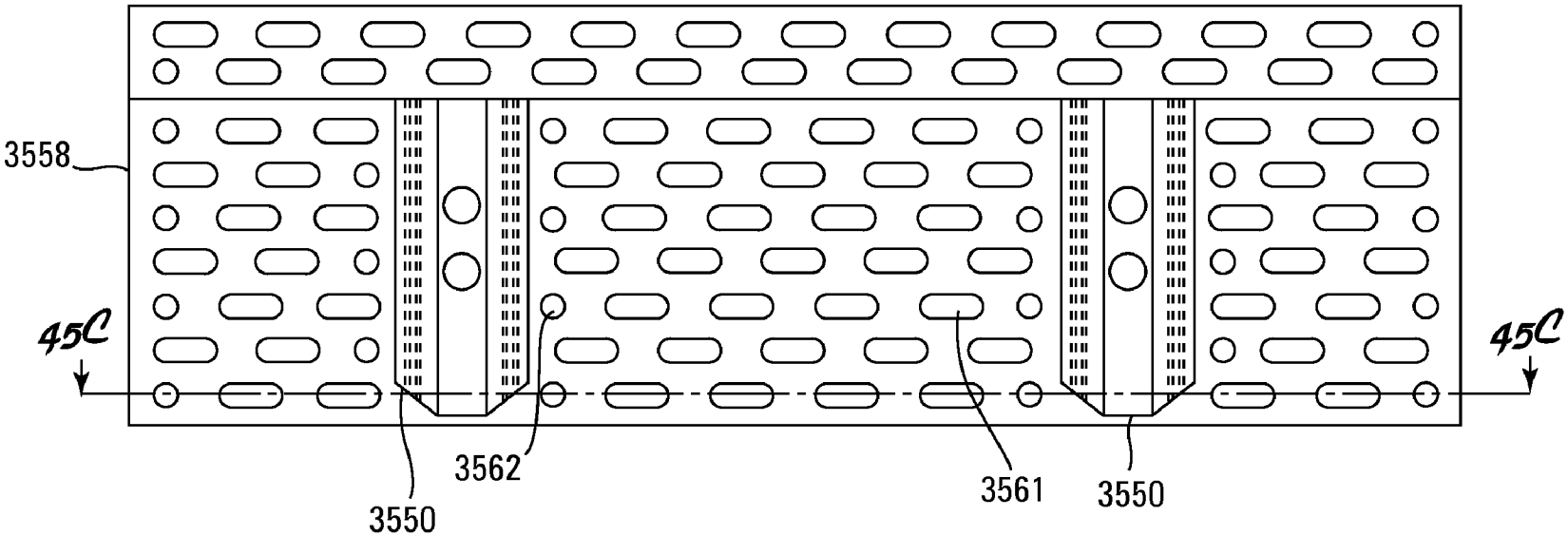
FIG. 45A is a front view of a veneer receiving tray.
Figure 45B:
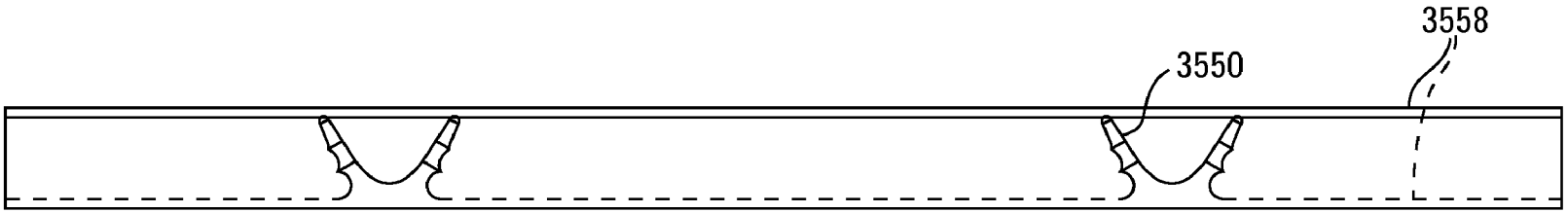
FIG. 45B is a top view of the tray of FIG. 45A.
Figure 45C:
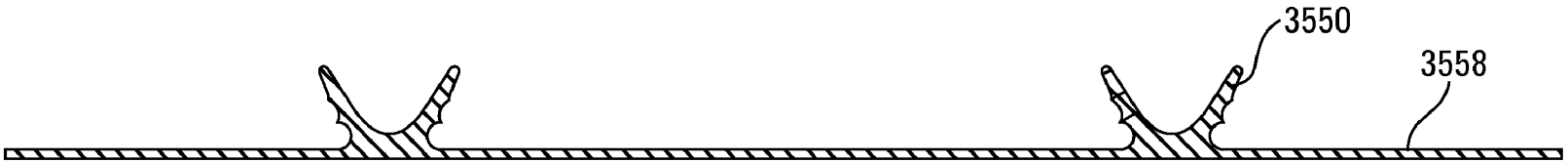
FIG. 45C is a cross-sectional view of the tray of FIG. 45A, taken along the line 45C shown in FIG. 45A.
Figure 45D:
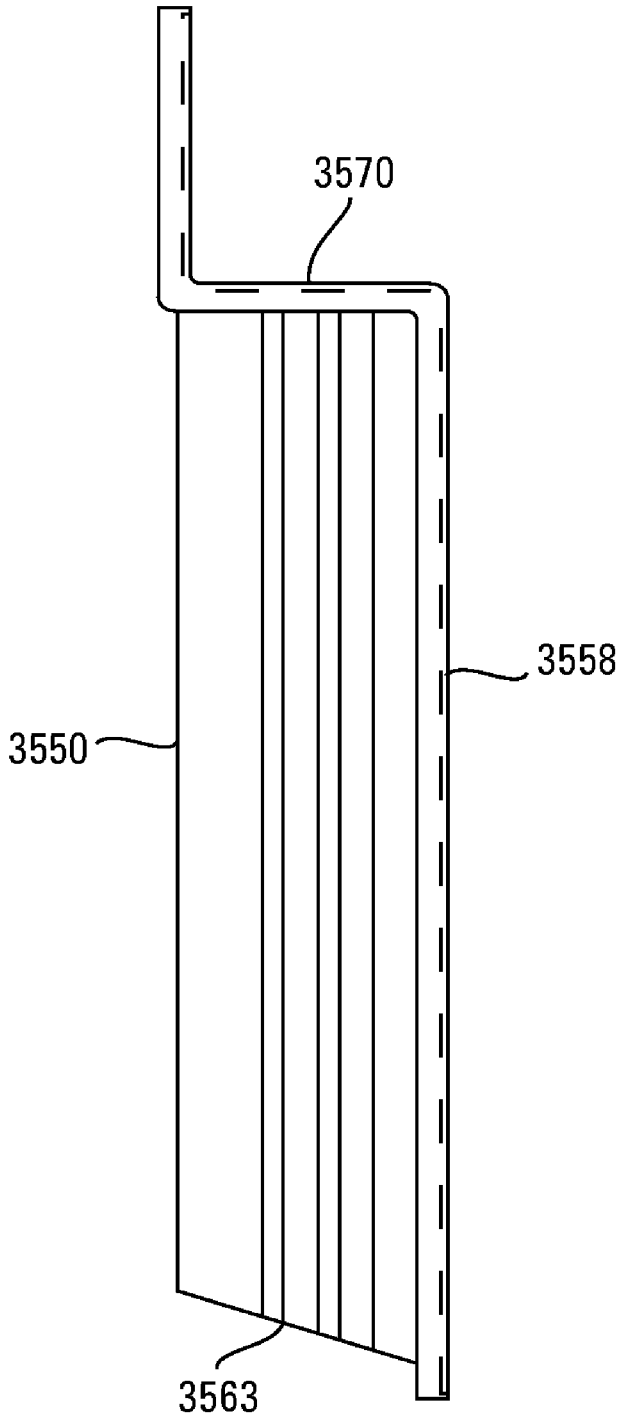
FIG. 45D is a side view of the tray of FIG. 45A.

As shown in FIG. 45D, the dovetail veneer connection portions 3550 have a taper 3563, which assists in smooth connection to the dovetail wall block connection spaces 2960 of retaining wall block 2910.

Figure 46:
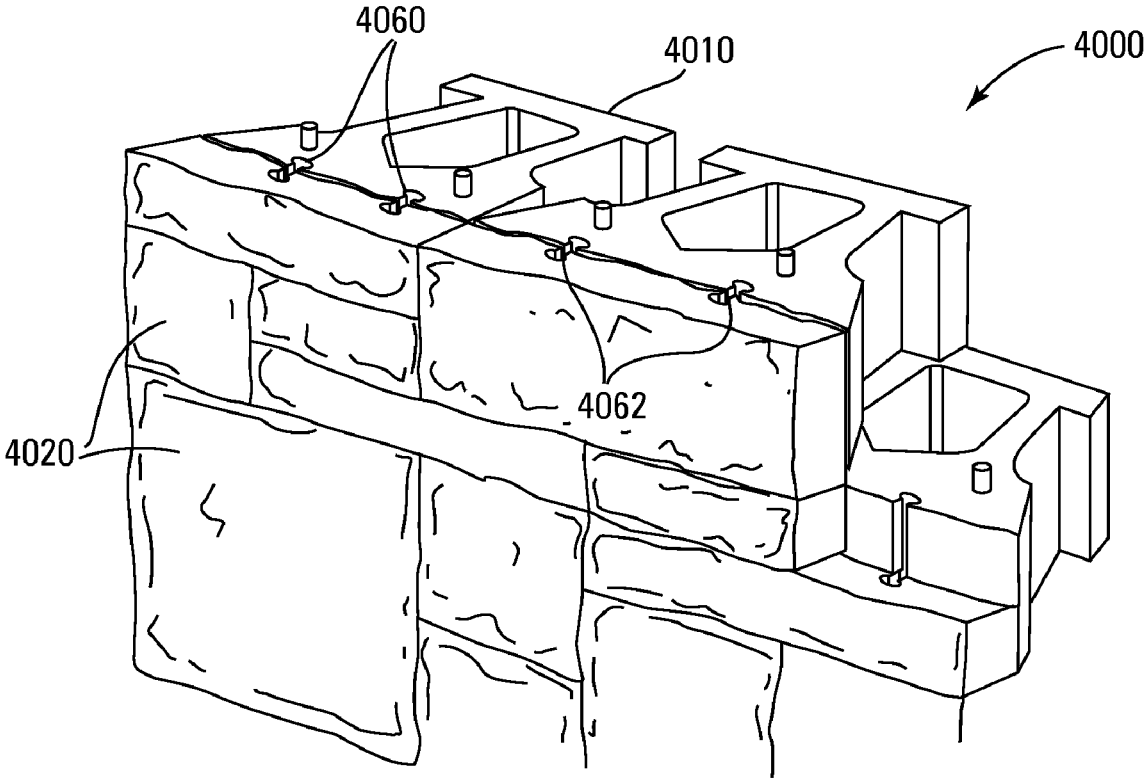
FIG. 46 is a perspective view of a wall.
Figure 47:
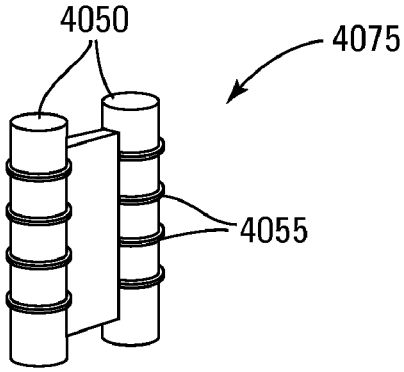
FIG. 47 is a perspective view of a connector.

FIG. 46 shows a wall 4000 made of wall blocks 4010 having wall block connection spaces 4060. Veneers 4020 of varying sizes and having veneer connection spaces 4062 are attached to the retaining wall blocks using a connector 4075, shown in FIG. 47. The connector 4075 has friction fins 4055 on each of its connection portions 4050. Preferably, the connector 4075 is attached to the veneer 4020 at the worksite by placing a connection portion 4050 of the connector 4075 into the veneer connection space 4062, and then the veneer 4020 is attached to the wall block 4010 by placing the other connection portion 4050 of the connector 4075 into the wall block connection space 4060. The veneer connection space 4062 and the wall block connection space 4060 are in the shape of a keyhole. The advantage of this type of connector is that it has the ability to pivot to an angle other than true perpendicular to the block and thereby allows the connector to fit to a veneer that may not align perfectly with the block. The preferred angle of pivot is between 0 and 5 degrees from each side of true perpendicular. This arrangement allows the use of a relatively rigid connector while still allowing for small variations in the size of the block and veneer.

Figure 48:
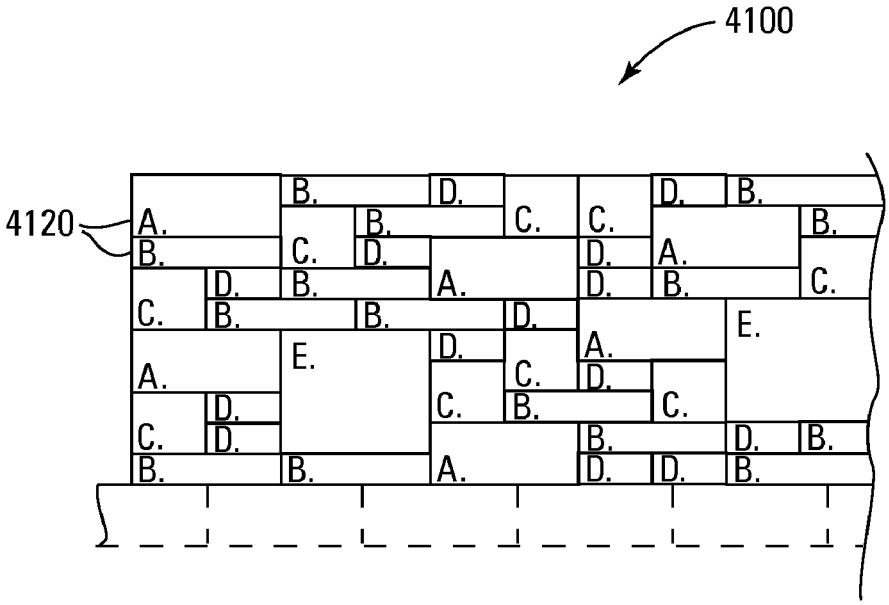
FIG. 48 is an elevation of a wall with veneer panels forming an ashlar pattern.
Figure 49:
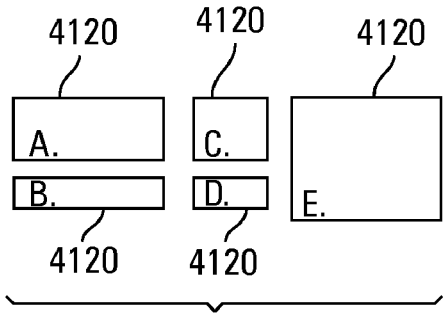
FIG. 49 is a diagram of veneers.

FIG. 48 shows a wall 4100 similar to the wall of FIG. 46 with various sized veneer pieces all assembled together. FIG. 49 shows the various sized veneers 4120 that are used in the wall 4100. The veneer labeled A has dimensions of 8 inches tall by 16 inches wide (20 cm by 41 cm); the veneer labeled B has dimensions of 4 inches tall by 16 inches wide (15 cm by 41 cm); the veneer labeled C has dimensions of 8 inches tall by 8 inches wide (20 cm by 20 cm); the veneer labeled D has dimensions of 4 inches tall by 8 inches wide (15 cm×20 cm); and the veneer labeled E has dimensions of 16 inches tall by 16 inches wide (41 cm×41 cm). The various sized veneers each have connection spaces to receive a connector similar to connector 4075. Veneers can have one to two or more connector fastening points, depending on the veneer size.

Figure 50:
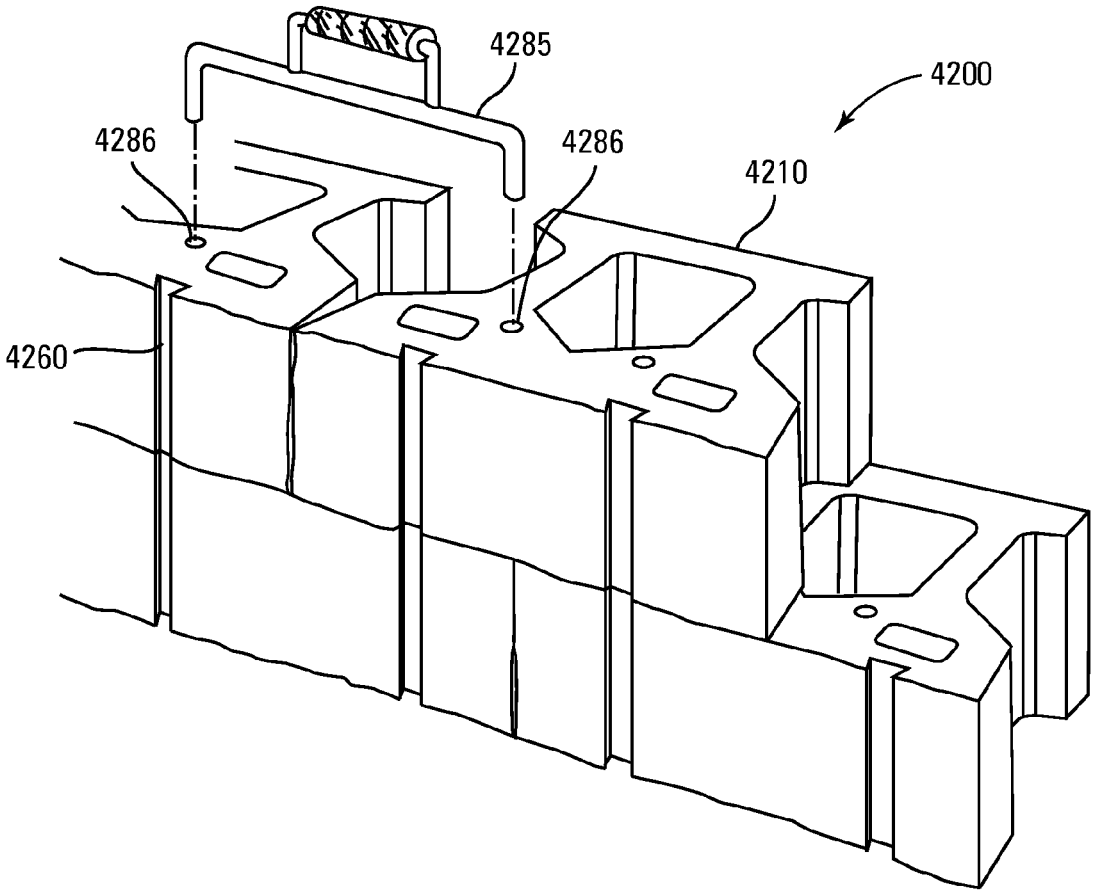
FIG. 50 is a perspective view of a wall assembly of retaining wall blocks.

FIG. 50 shows a wall 4200 made of wall blocks 4210 having wall block connection spaces 4260. A spacing tool 4285 is shown. The hand use spacing tool 4285 is used to align the connection spaces 4260 so that a large veneer can be slid onto or snapped into the connection spaces 4260. The spacing tool 4285 aligns the pin holes 4286. The pin holes 4286 accept pins that align the wall blocks 4210. Veneers larger than the wall blocks 4210 can be attached to the wall 4200 by using the aligned connection spaces 4260. The veneers can be snapped into or slid into the aligned connection spaces 4260.

Figure 51:
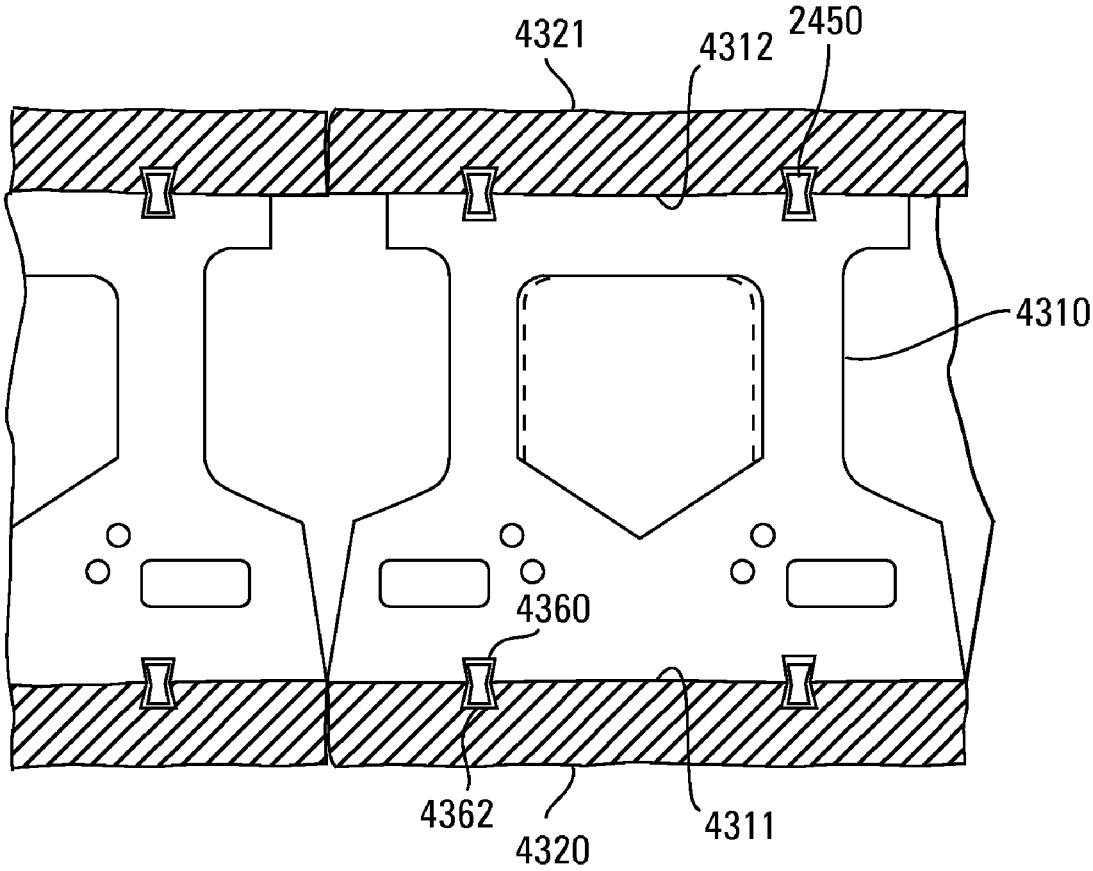
FIG. 51 is a top view of a wall block and veneer.

FIG. 51 shows a wall block 4310 having wall block connection spaces 4360. Veneers 4320, 4321 having veneer connection spaces 4362 are attached to the wall blocks using a connector 2450, shown in FIG. 30. The connector 2450 has friction fins 2455. Preferably, the connector 2450 is attached to the veneers 4320, 4321 at the worksite by placing a portion of the connector 2450 into the veneer connection spaces 4362, and then the veneers 4320, 4321 are attached to the wall block 4310 by placing the other portion of the connector 2450 into the wall block connection spaces 4360. As shown in FIG. 51, veneer 4320 has a width that matches the front face 4311 of the wall block and veneer 4321 has a width greater than the back face 4312 of the wall block. As the wall is being constructed, aggregate is poured into the wall cavities for drainage purposes.

Figure 52:
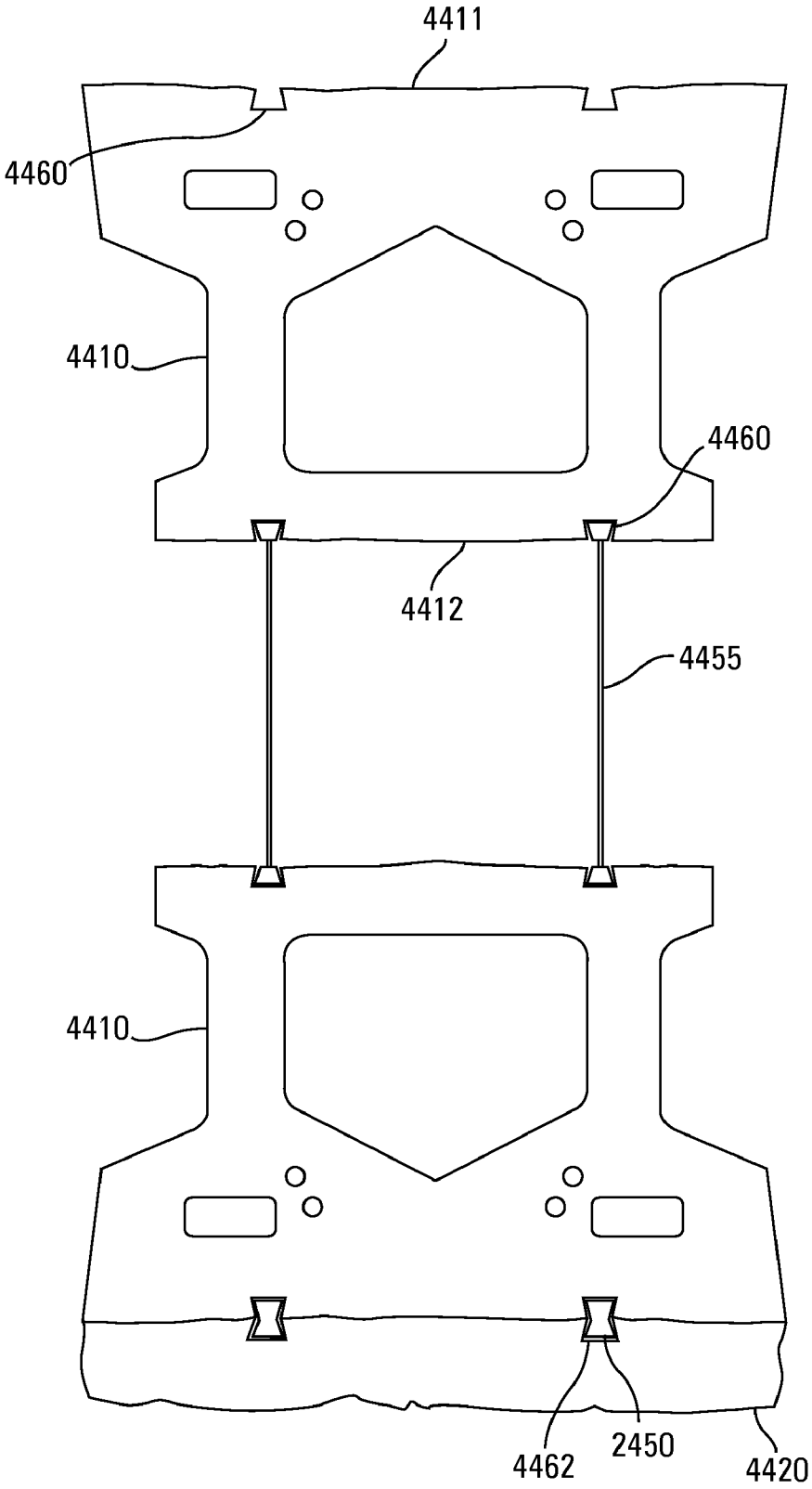
FIG. 52 is a top view of wall blocks and connectors.

FIG. 52 shows two wall blocks 4410 having wall block connection spaces 4460. Each wall block 4410 has a front face 4411 and a back face 4412. The back faces 4412 of the wall blocks are connected by tensile connectors 4455. Veneers 4420 having veneer connection spaces 4462 are attached to the front faces 4411 of the wall blocks using a connector 2450, shown in FIG. 30. The connector 2450 has friction fins 2455. Preferably, the connector 2450 is attached to the veneers 4420 at the worksite by placing a portion of the connector 2450 into the veneer connection spaces 4462, and then the veneers 4420 are attached to the wall blocks 4410 by placing the other portion of the connector 2450 into the wall block connection spaces 4460 on the front faces 4411 of the wall blocks.

Although particular embodiments have been disclosed herein in detail, this has been done for purposes of illustration only, and is not intended to be limiting with respect to the scope of the following appended claims. In particular, it is contemplated by the inventors that various substitutions, alterations, and modifications may be made to the invention without departing from the spirit and scope of the invention as defined by the claims. For instance, the choices of materials or variations in shapes are believed to be a matter of routine for a person of ordinary skill in the art with knowledge of the embodiments disclosed herein.

What is claimed is:

1. A combination comprising a wall block and a veneer, the wall block having opposed top and bottom surfaces, opposed first and second side surfaces and a front face, the front face having a block connection space, the top surface having an upper portion and a lower recessed portion that is vertically recessed from the upper portion, the veneer having opposed top and bottom surfaces, opposed first and second side surfaces and a front face, the veneer having a veneer connection portion which is shaped to interlock with the block connection space to attach the veneer to the front face of the wall block, and the top surface of the veneer having a lip shaped to be received in the lower recessed portion of the top surface of the wall block.

2. The combination of claim 1, wherein the front face of the veneer is the same size as the front face of the wall block.

3. The combination of claim 1, wherein the front face of the veneer is larger than the front face of the wall block.

4. The combination of claim 1, wherein the veneer connection portion and the block connection space form a dovetail connection.

5. The combination of claim 1, wherein the veneer is a pre-cast concrete veneer.

6. The combination of claim 5, wherein the wall block is a dry cast concrete wall block.

7. The combination of claim 5, wherein the wall block is a wet cast concrete wall block.

8. The combination of claim 1, wherein the veneer is a real stone veneer.

9. The combination of claim 8, wherein the wall block is a dry cast concrete wall block.

10. The combination of claim 8, wherein the wall block is a wet cast concrete wall block.

11. The combination of claim 1, wherein the veneer is made of polymer.

12. The combination of claim 11, wherein the wall block is a dry cast concrete wall block.

13. The combination of claim 11, wherein the wall block is a wet cast concrete wall block.

14. The combination of claim 1, wherein the wall block has an open space.

15. The combination of claim 1, wherein the wall block has a rear face, the rear face having a block connection space, and further comprising a second veneer attached to the rear face of the wall block.

16. The combination of claim 1, wherein the veneer connection portions comprise friction fins.

17. The combination of claim 1, wherein the block connection space is in the shape of a cylinder, trapezoidal column, hexagonal column, or keyhole-shaped column.

18. The combination of claim 1, wherein the wall block comprises two or more wall block connection spaces.

19. The combination of claim 18, wherein the wall block comprises two wall block connection spaces.

20. The combination of claim 18, wherein the wall block comprises three wall block connection spaces.

21. The combination of claim 1, wherein the veneer connection portion can be slid into the block connection space.

22. The combination of claim 1, wherein the veneer connection portion can be snapped into the block connection space.

23. A wall comprising a combination of claim 1.

24. A combination comprising a wall block, a veneer, and a connector, the wall block having opposed top and bottom surfaces, opposed first and second side surfaces and a front face, the front face having a block connection space, the top surface having an upper portion and a lower recessed portion that is vertically recessed from the upper portion, the veneer having opposed top and bottom surfaces, opposed first and second side surfaces and a front face, the veneer having a veneer connection space, and the top surface of the veneer having a lip shaped to be received in the lower recessed portion of the top surface of the wall block, the connector being shaped to interlock with the block connection space and the veneer connection space to attach the veneer to the front face of the wall block.

25. The combination of claim 24, wherein the front face of the veneer is the same size as the front face of the wall block.

26. The combination of claim 24, wherein the front face of the veneer is larger than the front face of the wall block.

27. The combination of claim 24, wherein the block connection space and the veneer connection space are in the shape of a cylinder, trapezoidal column, hexagonal column, or keyhole-shaped column.

28. The combination of claim 24, wherein the wall block has a rear face, the rear face having a block connection space, and further comprising a second veneer attached to the rear face of the wall block.

29. The combination of claim 24, wherein the connector comprises friction fins.

30. A wall comprising a combination of claim 24.

31. The combination of claim 1, wherein the top surface and at least one of the bottom surface, first side surface and second side surface of the wall block have a recessed portion and the top surface and at least one of the bottom surface, first side surface and second side surface of the veneer have a lip shaped to be received in the recessed portion of the top surface and at least one bottom surface, first side surface and second side surface of the wall block.

32. The combination of claim 31, wherein the first side surface of the wall block has a recessed portion and the first side surface of the veneer has a lip shaped to be received in the recessed portion of the first side surface of the wall block.

33. The combination of claim 32, wherein the second side surface of the wall block has a recessed portion and the second side surface of the veneer has a lip shaped to be received in the recessed portion of the second side surface of the wall block.

34. The combination of claim 33, wherein the bottom surface of the wall block has a recessed portion and the bottom surface of the veneer has a lip shaped to be received in the recessed portion of the bottom surface of the wall block.

35. The combination of claim 31, wherein the bottom surface of the wall block has a recessed portion and the bottom surface of the veneer has a lip shaped to be received in the recessed portion of the bottom surface of the wall block.

* * * * *